US012161923B2

(12) United States Patent
Spackman

(10) Patent No.: US 12,161,923 B2
(45) **Date of Patent: *Dec. 10, 2024**

(54) HOLLOW BODY CLUB HEADS WITH FILLER MATERIALS

(71) Applicant: KARSTEN MANUFACTURING CORPORATION, Phoenix, AZ (US)

(72) Inventor: Clayson C. Spackman, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 43 days.

This patent is subject to a terminal disclaimer.

(21) Appl. No.: 17/647,573

(22) Filed: Jan. 10, 2022

(65) Prior Publication Data

US 2022/0126181 A1 Apr. 28, 2022

Related U.S. Application Data

(63) Continuation of application No. 16/805,554, filed on Feb. 28, 2020, now Pat. No. 11,235,215.

(60) Provisional application No. 62/812,780, filed on Mar. 1, 2019.

(51) Int. Cl.
*A63B 60/54* (2015.01)
*A63B 53/04* (2015.01)

(52) U.S. Cl.
CPC ..... *A63B 60/54* (2015.10); *A63B 53/0412* (2020.08); *A63B 53/0466* (2013.01); *A63B 53/047* (2013.01); *A63B 2053/0479* (2013.01); *A63B 2209/00* (2013.01)

(58) Field of Classification Search
CPC ..... A63B 60/54; A63B 53/047; A63B 2053/0479; A63B 2209/00; A63B 53/0466; A63B 53/0412; A63B 53/0408; A63B 53/0429; A63B 53/0425
USPC ..... 473/324–350, 287–292
See application file for complete search history.

(56) References Cited

U.S. PATENT DOCUMENTS

| | | | | |
|---|---|---|---|---|
| 5,184,823 A | | 2/1993 | Desbiolles | |
| 5,290,036 A | * | 3/1994 | Fenton | A63B 53/04 273/DIG. 8 |
| 5,429,353 A | | 7/1995 | Hoeflich | |
| 5,766,092 A | * | 6/1998 | Mimeur | A63B 60/00 473/332 |
| 6,354,962 B1 | | 3/2002 | Galloway | |

(Continued)

OTHER PUBLICATIONS

International Search Report and Written Opinion for PCT Application No. PCT/US2020/020510, 9 pages, May 6, 2020.

(Continued)

*Primary Examiner* — Sebastiano Passaniti

(57) ABSTRACT

Embodiments of golf club heads comprising a nanocomposite to attenuate sound of the club head are described herein. The nanocomposite comprises graphene and a polymer. The graphene can be in the form of a powder, where the graphene is suspended within the polymer. The nanocomposite can be disposed within an interior surface of the club head. The nanocomposite can be applied to selected portions of the club head such as behind the strike face. The nanocomposite comprising graphene and the polymer can provide an alternative filler material over homogenous materials to attenuate the sound to provide a pleasing sound and feel to a golfer.

9 Claims, 18 Drawing Sheets

(56) References Cited

U.S. PATENT DOCUMENTS

| | | | | |
|---|---|---|---|---|
| 6,491,592 | B2 | 12/2002 | Cackett | |
| 6,758,763 | B2 | 7/2004 | Murphy | |
| 6,902,495 | B2 | 6/2005 | Pergande | |
| 7,118,493 | B2 | 10/2006 | Galloway | |
| 7,182,698 | B2 * | 2/2007 | Tseng | A63B 53/0475 473/332 |
| 7,318,781 | B2 | 1/2008 | Deshmukh | |
| 7,320,646 | B2 | 1/2008 | Galloway | |
| 7,556,567 | B2 | 7/2009 | Galloway | |
| 7,744,486 | B2 * | 6/2010 | Hou | A63B 53/047 473/332 |
| 7,819,757 | B2 | 10/2010 | Soracco | |
| 7,922,604 | B2 | 4/2011 | Roach | |
| 8,425,349 | B2 | 4/2013 | Dawson | |
| 8,460,123 | B1 | 6/2013 | Demille | |
| 8,496,542 | B2 | 7/2013 | Curtis | |
| 8,517,859 | B2 | 8/2013 | Golden | |
| 8,529,370 | B1 | 9/2013 | Galloway | |
| 8,758,161 | B2 | 6/2014 | Golden | |
| 8,864,602 | B2 | 10/2014 | Curtis | |
| 8,870,682 | B2 | 10/2014 | Roach | |
| 8,876,629 | B2 | 11/2014 | Deshmukh | |
| 9,033,818 | B2 | 5/2015 | Myrhum | |
| 9,033,822 | B1 | 5/2015 | DeMille | |
| 9,192,826 | B2 | 11/2015 | Golden | |
| 9,199,137 | B2 | 12/2015 | Deshmukh | |
| 9,370,698 | B2 | 6/2016 | Deshmukh | |
| 9,504,883 | B2 | 11/2016 | DeMille | |
| 9,526,955 | B2 | 12/2016 | DeMille | |
| 9,586,104 | B2 | 3/2017 | Roach | |
| 9,662,549 | B2 | 5/2017 | Vrska | |
| 9,717,960 | B2 | 8/2017 | Deshmukh | |
| 9,808,682 | B2 | 11/2017 | DeMille | |
| 9,808,685 | B1 | 11/2017 | Westrum | |
| 9,861,866 | B2 | 1/2018 | DeMille | |
| 9,937,388 | B2 | 4/2018 | Cardani | |
| 10,039,964 | B1 | 8/2018 | Westrum | |
| 10,052,535 | B1 | 8/2018 | Westrum | |
| 10,143,898 | B2 | 12/2018 | Cornelius | |
| 10,173,108 | B2 | 1/2019 | Westrum | |
| 10,357,901 | B2 | 7/2019 | Deshmukh | |
| 10,420,993 | B2 | 9/2019 | Pergande | |
| 11,235,215 | B2 * | 2/2022 | Spackman | A63B 60/002 |
| 2002/0098910 | A1 * | 7/2002 | Gilbert | A63B 60/02 473/332 |
| 2005/0096151 | A1 | 5/2005 | Hou | |
| 2006/0258480 | A1 | 11/2006 | Hou | |
| 2010/0125000 | A1 * | 5/2010 | Lee | A63B 60/00 473/282 |
| 2010/0125013 | A1 * | 5/2010 | Lammer | A63B 60/00 156/62.2 |
| 2011/0028240 | A1 * | 2/2011 | Wahl | B23P 17/04 473/346 |
| 2013/0225320 | A1 | 8/2013 | Woolley | |
| 2013/0318772 | A1 * | 12/2013 | Wahl | A63B 60/00 29/530 |
| 2015/0360094 | A1 | 12/2015 | Deshmukh | |
| 2016/0038799 | A1 | 2/2016 | de la Cruz | |
| 2016/0045792 | A1 | 2/2016 | Ines | |
| 2016/0045793 | A1 * | 2/2016 | Cardani | A63B 53/047 473/332 |
| 2017/0266519 | A1 | 9/2017 | Vrska | |
| 2019/0247726 | A1 * | 8/2019 | Parsons | A63B 53/047 |
| 2019/0315909 | A1 | 10/2019 | Luesing | |
| 2020/0062914 | A1 | 2/2020 | Rizzi | |

OTHER PUBLICATIONS

Unwin et al., Escaping the Ashby limit for mechanical damping/stiffness trade-off using a constrained high internal friction interfacial layer, 10 pages, Scientific Reports, Feb. 6, 2018.

* cited by examiner

| MODE | FREQUENCY (Hz) |
|---|---|
| 7 | **2811** |
| 8 | **3227** |
| 9 | **4009** |
| 10 | 5689 |
| 11 | **6124** |
| 12 | 7386 |

HOLLOW BODY CLUB HEADS WITH FILLER MATERIALS

CROSS REFERENCE TO RELATED APPLICATIONS

This is a continuation of U.S. patent application Ser. No. 16/805,554, filed on Feb. 28, 2020, which claims the benefit of U.S. Provisional Application No. 62/812,780, filed on Mar. 1, 2019, wherein the contents of all above-described disclosures are incorporated herein by reference in their entirety.

FIELD OF THE INVENTION

This invention generally relates to golf club heads using filler materials to attenuate sound of the club head after golf ball impacts.

BACKGROUND

Golf club design takes into account several performance characteristics, such as sound attenuation. Golf club design aims to provide a pleasing sound and feel to a golfer during impacts with a golf ball to ensure the golfer is confident in their hitting performance. In addition, these characteristics provide feedback regarding how well the ball has been struck by the golfer. Typically, sound attenuation is achieved through inserting a material with damping properties within the club head. Typically, these filler materials provide damping properties, but providing additional mass to the club head affects the club head characteristics such as center of gravity location or moment of inertia. Therefore, there is a need in the art for a low mass filler material that provides a means for attenuating the sound of the club head after golf ball impacts.

Figure 1:
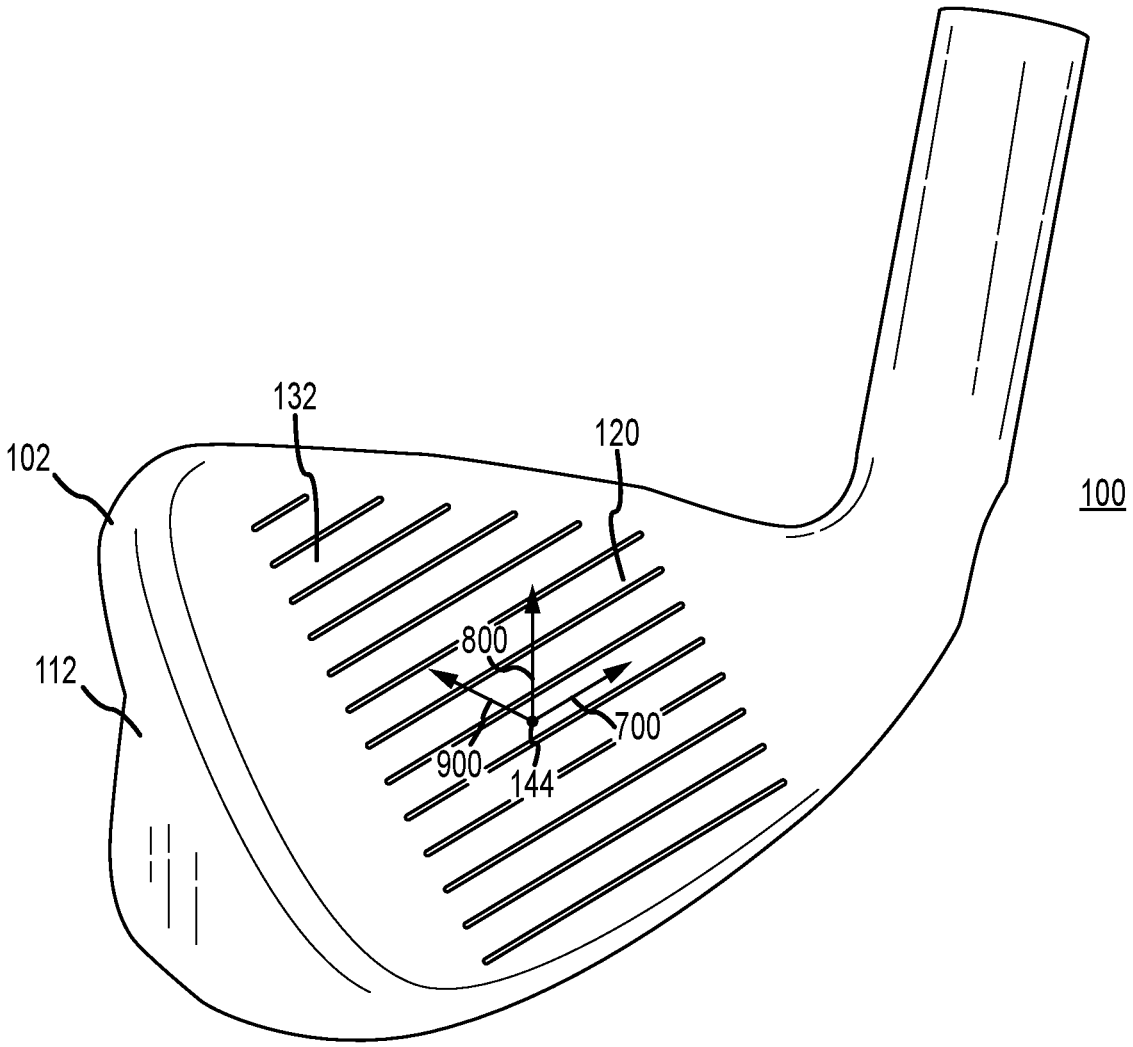
FIG. 1 illustrates a front perspective view of a golf club head according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The present embodiments discussed below are directed to hollow body club heads with cavities that receive a filler material to attenuate sound and provide better vibrational control. Specifically, the filler material comprises a filler and a carrier. The filler is graphene, and the carrier is a polymer. The combination of filler and the carrier forms a nanocomposite. The nanocomposite is a heterogenous mixture, where the filler is suspended within the carrier. The nanocomposite is positioned within an interior surface of the club head such as behind the strike face to attenuate sound and provide vibrational control.

The nanocomposite including graphene and the polymer provides exceptional sound attenuation and vibrational control. As described in more detail below, the club head vibrates and produces a sound after golf ball impacts. Club head vibration comprises one or more modes of frequency that produce desirable and undesirable sounds. To damp or attenuate undesirable sounds and feel, the nanocomposite filler material is used. The ability for the nanocomposite to damp sound is largely dependent on the surface area the sound travels through. Graphene, on a molecular level, comprises a large surface area per volume compared to most materials, thereby absorbing and dispersing a greater amount of the sound within the nanocomposite. The nanocomposite is highly desirable in attenuating sound to provide 1) a material that does not add a significant amount of mass to the club head, (2) a material that provides a pleasing sound and feel, and (3) an alternative material that attenuates sound just as well as homogenous materials or composites.

The terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) can be for any length of time, e.g., permanent or semi-permanent or only for an instant.

The terms "loft" or "loft angle" of a golf club, as described herein, refers to the angle formed between the club face and the shaft, as measured by any suitable loft and lie machine.

Embodiments of a golf club head are described herein, wherein the golf club head can comprise a hollow body club head. More specifically, the club head can be a driver, a fairway wood, hybrid, iron, wedge, or other hollow body club heads.

For example, in some embodiments, the driver comprises a loft angle and a volume. In many embodiments, the loft angle of the driver is less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, the volume of the driver is greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

For further example, in some embodiments, the fairway wood comprises a loft angle and a volume. In many embodiments, the loft angle of the fairway wood is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the fairway wood is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway wood can be between 12 degrees and 35 degrees, between 15 degrees and 35 degrees, between 20 degrees and 35 degrees, or between 12 degrees and 30 degrees.

Further, in many embodiments, the volume of the fairway wood is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

For further example, in some embodiments, the hybrid comprises a loft angle and a volume. In many embodiments, the loft angle of the hybrid is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, in many embodiments, the volume of the hybrid is less than approximately 200 cc, less than approximately 175 cc, less than approximately 150 cc, less than approximately 125 cc, less than approximately 100 cc, or less than approximately 75 cc. In some embodiments, the volume of the hybrid-type club head can be approximately 100 cc-150 cc, approximately 75 cc-150 cc, approximately 100 cc-125 cc, or approximately 75 cc-125 cc.

For further example, in some embodiments, the iron comprises a loft angle less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees or less than approximately 18 degrees.

Further, in some embodiments, the loft angle of the iron can be greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, greater than approximately 38 degrees, greater than approximately 39 degrees, greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, greater than approximately 50 degrees, greater than approximately 51 degrees, greater than approximately 52 degrees, greater than approximately 53 degrees, greater than approximately 54 degrees, greater than approximately 55 degrees, greater than approximately 56 degrees, greater than approximately 57 degrees, greater than approximately 58 degrees, greater than approximately 59 degrees, or greater than approximately 60 degrees.

The volume of the iron can be greater than or equal to 20 cubic centimeters (cc) and less than or equal to 80 cubic centimeters (cc). In some embodiments, the volume of the iron can range from 20 to 50 cc, or 50 to 80 cc. In other embodiments, the volume of the iron can range from 20 to 60 cc, 30 to 70 cc, or 40 to 80 cc. For example, the volume of the iron can be 20, 30, 40, 50, 60, 70, or 80 cc.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Filler Material

The hollow body construction of the club head allows for the filler material to be disposed within the cavity. The filler material can be disposed or applied to the interior surface of the club head. In some embodiments, the filler material can be applied as a paint to the entire interior surface or selected locations of the interior surface. In other embodiments, the filler material can be injected into the cavity, for example, but not limited to, through a weight port or an opening that allows access to the interior surface of the club head to fill a volume percentage of the cavity. The filler material is used to attenuate sound to provide a pleasing sound and feel to the golfer. The filler material is used to control the vibration of the club head after golf ball impacts. Described below is a few embodiments and advantages of the filler material.

The filler material can comprise a composite. Specifically, the composite can comprise a soft composite or nanocomposite. Nanocomposites are multiphase materials, where at least one phase comprises a grain size measured in nanometers. In some embodiments, the grain size of at least one phase of the nanocomposite can be less than 100 nanometers. In some embodiments, the grain size of the nanocomposite can be less than 90, 80, 70, 60, 50, or 40 nanometers. Nanocomposites differ from conventional composite materials due to the exceptionally high surface area to volume ratio and/or its exceptionally high aspect ratio. An example of a nanocomposite can be a combination of graphene and a polymer.

The nanocomposite can comprise a heterogenous mixture having a filler and a carrier. In these heterogenous mixtures, the filler can be mixed with the carrier such that the filler is suspended within the carrier. In one embodiment, the filler can comprise graphene and the carrier can comprise a polymer. In another embodiment, the filler can comprise graphene and the carrier can comprise a polyurethane. In another embodiment still, the filler can comprise graphene and the carrier can comprise a polyurethane adhesive.

Graphene can be in the form of a solid such as a powder. The powder can be crystal structures. The crystal structures can comprise crystalline allotropes of carbon. The crystalline allotrope of carbon can comprise a single layer of carbon atoms.

Graphene can also comprise a two-dimensional hexagonal lattice pattern. The carbon atoms of graphene are arranged in a densely packed hexagonal lattice pattern. In one example, the graphene in the form of the powder can be Graphene Black 3X (Nanoxplore, Canada). Graphene in powder form can comprise a plurality of flakes, where the plurality of flakes comprise an average flake size of approximately 40 micrometers. The flake size can correspond to a diameter of the flakes. In other embodiments, the diameter of the flakes can range from 10 microns to 10000 microns. Graphene in powder form can have a density of approximately 0.18 g/cc. The chemical composition of graphene in powder form can comprise greater than 91% carbon, less than 7% oxygen, less than 0.5% sulfur, and less than 2% metal impurities. Graphene in powder form is further insoluble, where it does not dissolve when mixed with carrier. The two-dimensional arrangement of the carbon atoms of graphene allows for a large surface area per volume ratio compared to other materials. The specific surface area of graphene can be 2630 $m^2/g$. The large surface area is beneficial in absorbing and dissipating sound within graphene.

The carrier of the nanocomposite can comprise a polymer. The polymer can comprise a thermoplastic, a thermoplastic elastomer, polyurethane, ethylene, vinyl acetate, ethylene vinyl acetate (EVA), polyolefin copolymer, styrene, styrene-butadiene, any other suitable polymer material, or any combination thereof. In other embodiments, the carrier can comprise an elastomer, a polyurethane elastomer, a silicone, a silicone elastomer, a rubber, or a vulcanized natural rubber latex. In other embodiments still, the carrier can be an epoxy, a resin, an adhesive, a polyurethane adhesive, a glue, or any other suitable adhesive. For example, the carrier can be a polyurethane adhesive such as Gorilla Glue (Gorilla Glue Company, Cincinnati Ohio). In another example, the carrier can be a polyurethane elastomer such as Freeman 1040 (Freeman Manufacturing & Supply Company, Avon Ohio), or a polyurethane based thermoplastic elastomer such as Freeman 3040 (Freeman Manufacturing & Supply Company, Avon Ohio).

The nanocomposite can comprise a density. The density of the nanocomposite can be greater than or equal to 0.8 g/cc and less than or equal to 2.0 g/cc. In some embodiments, the density of the nanocomposite can range from 0.8 to 1.5 g/cc, or 1.5 to 2.0 g/cc. In some embodiments, the density of the nanocomposite can range from 0.8 to 1.3 g/cc, 0.9 to 1.4 g/cc, 1.0 to 1.5 g/cc, 1.1 to 1.6 g/cc, 1.2 to 1.7 g/cc, 1.3 to 1.8 g/cc, 1.4 to 1.9 g/cc, or 1.5 to 2.0 g/cc. For example, the density of the nanocomposite can be 0.8, 0.9, 0.95, 1.0, 1.1, 1.2, 1.3, 1.4, 1.5, 1.6, 1.7, 1.8, 1.9, or 2.0 g/cc.

In many embodiments, the nanocomposite can comprise a hardness. The hardness of the nanocomposite can be less than or equal to Shore A 50 (Shore durometer hardness type A scale). In some embodiments, the hardness of the nanocomposite can be less than Shore A 45, less than Shore A 40, less than Shore A 35, less than Shore A 30, less than Shore A 25, less than Shore A 20, or less than Shore A 10. In other embodiments, the hardness of the nanocomposite can range from Shore A 0 to Shore A 50. In some embodiments, the hardness of the nanocomposite can range from Shore A 0 to Shore A 25, or Shore A 25 to Shore A 50. In some embodiments, the hardness of the nanocomposite can range from Shore A 0 to Shore A 15, Shore A 10 to Shore A 25, Shore A 15 to Shore A 30, Shore A 20 to Shore A 35, Shore A 25 to Shore A 40, Shore A 30 to Shore A 45, or Shore A 35 to Shore A 50. For example, the hardness of the nanocomposite can be Shore A 0, Shore A 5, Shore A 10, Shore A 15, Shore A 20, Shore A 25, Shore A 30, Shore A 35, Shore A 40, Shore A 45, or Shore A 50.

In some embodiments, the hardness of the nanocomposite can be less than Shore OO 90 (Shore durometer hardness type 00 scale). In some embodiments, the hardness of the nanocomposite can be less than Shore OO 80, less than Shore OO 70, less than Shore OO 60, less than Shore OO 50, less than Shore OO 40, less than Shore OO 30, or less than Shore OO 20. In some embodiments, the hardness of the nanocomposite can range from Shore OO 0 to Shore OO 90. In some embodiments, the hardness of the nanocomposite can range from Shore OO 0 to Shore OO 45, or Shore OO 45 to Shore OO 90. In some embodiments, the hardness of the nanocomposite can range from Shore OO 0 to Shore OO 30, Shore OO 30 to Shore OO 60, or Shore OO 60 to Shore OO 90. In some embodiments, the hardness of the nanocomposite can range from Shore OO 60 to Shore OO 75, Shore OO 65 to Shore OO 80, Shore OO 70 to Shore OO 85, or Shore OO 75 to Shore OO 90. For example, the hardness of the nanocomposite can be Shore OO 0, Shore OO 5, Shore OO 10, Shore OO 15, Shore OO 20, Shore OO 25, Shore OO 30, Shore OO 35, Shore OO 40, Shore OO 45, Shore OO 50, Shore OO 55, Shore OO 60, Shore OO 65, Shore OO 70, Shore OO 75, Shore OO 80, Shore OO 85, or Shore OO 90.

For ease of discussion and understanding, and for purposes of description only, the following description illustrates the club head as a hollow body iron or a driver. It should be appreciated that the hollow body iron or driver is provided for purposes of illustration of the filler material to attenuate sound. The disclosed filler material can be used in association with any desired driver, fairway wood, wood generally, hybrid, iron, wedge, or other hollow body club heads.

Hollow Body Iron

Referring to the drawings, wherein like reference numerals are used to identify like or identical components in various views, FIGS. 1-10 schematically illustrate a first embodiment of the present design. Specifically, FIG. 1 illustrates a front perspective view of a hollow body iron 100. The club head 100 comprises a body 102 having a top rail 104, a sole 108 opposite the top rail 104, a toe end 112, and a heel end 116 opposite the toe end 112. The club head 100 further includes a strike face 120 and a rear 124 opposite the strike face 120. In one embodiment, the strike face 120, the top rail 104, the sole 108, the toe end 112, the heel end 116, and the rear 124 can be integral with each other and form a closed/hollow interior volume. In another embodiment, the strike face 120 and the body 102 can be formed separately and be secured together to form the closed/hollow interior volume. The closed/hollow interior volume defines a cavity 128.

Figure 4:
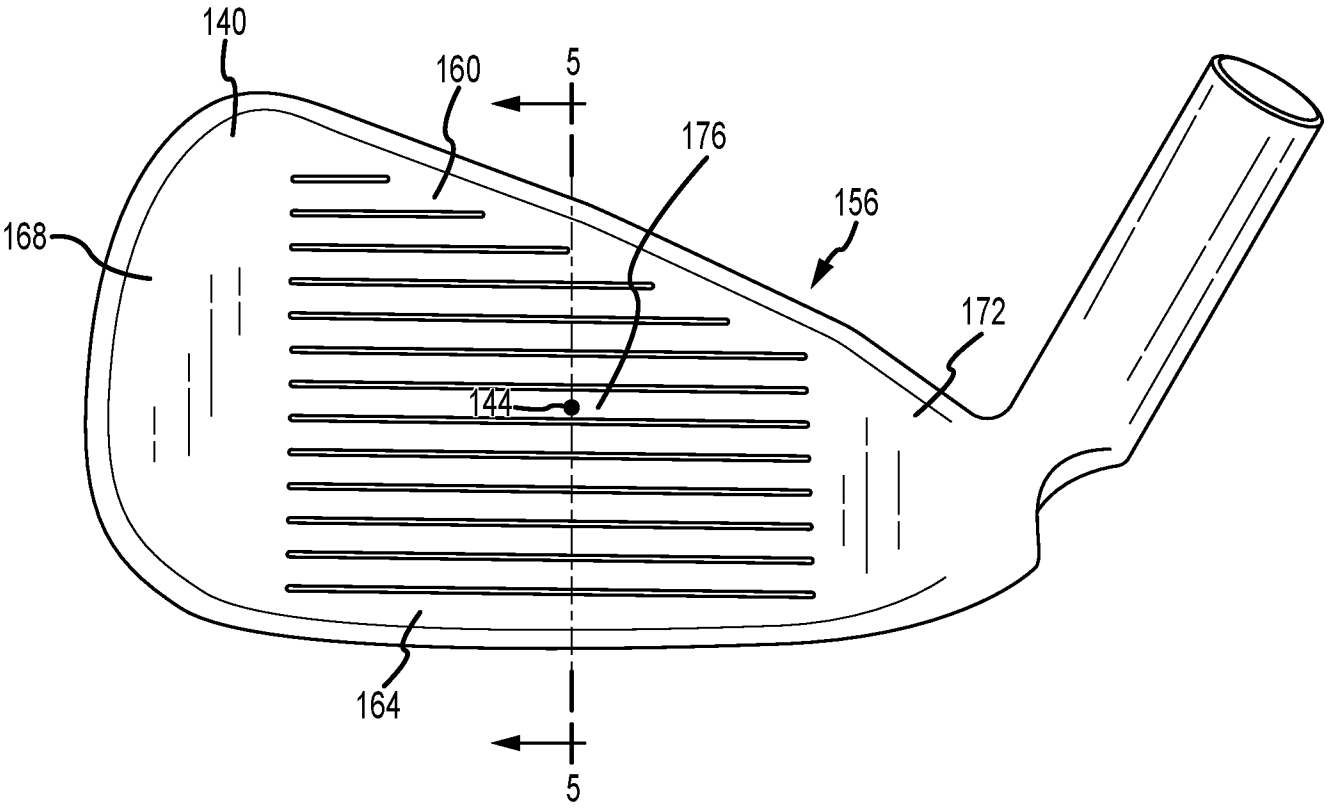
FIG. 4 illustrates a front view of the club head of FIG. 1.
Figure 5:
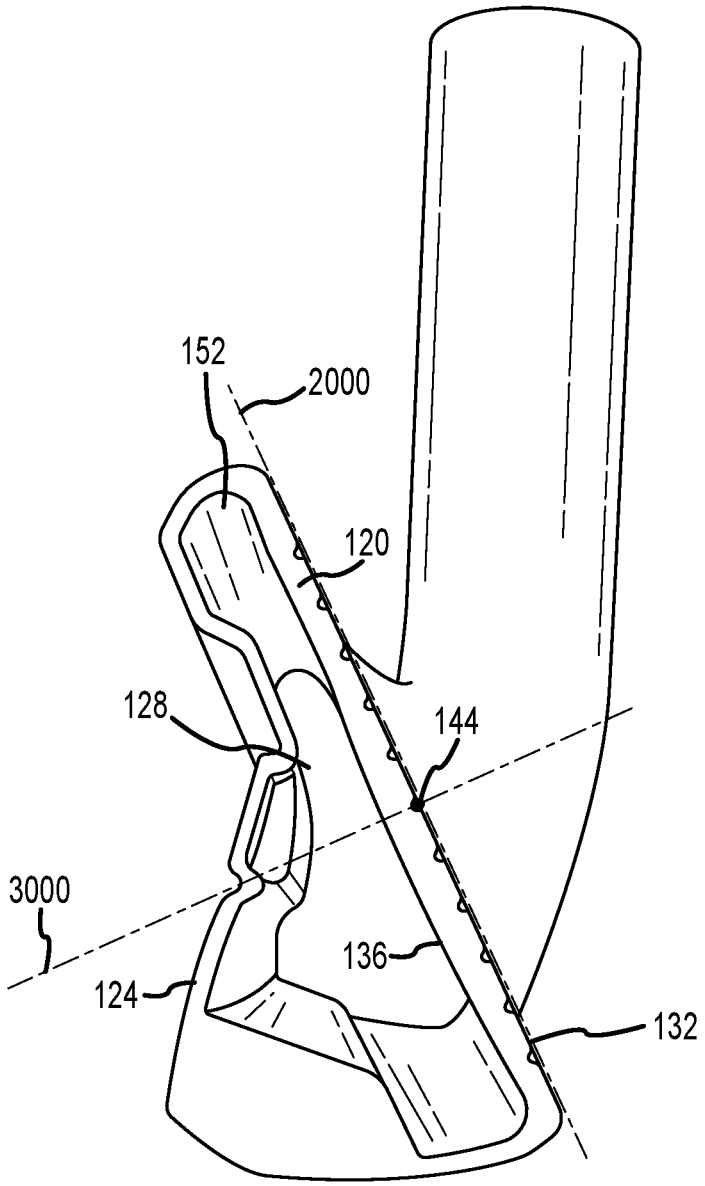
FIG. 5 illustrates a cross sectional view of the club head of FIG. 1 taken at line 5-5 of FIG. 4.

Referring to FIGS. 1 and 4, the strike face 120 of the club head 100 comprises a striking surface 132 intended to impact a golf ball, and a back surface 136 opposite the striking surface 132. The striking surface 132 further defines a geometric center 144. In some embodiments, the geometric center 144 can be located at the geometric centerpoint of a striking surface perimeter 140. In another approach, the geometric center 144 of the striking surface 132 can be located in accordance with the definition of a golf governing body such as the United States Golf Association (USGA). For example, the geometric center 144 of the striking surface 132 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

Figure 2:
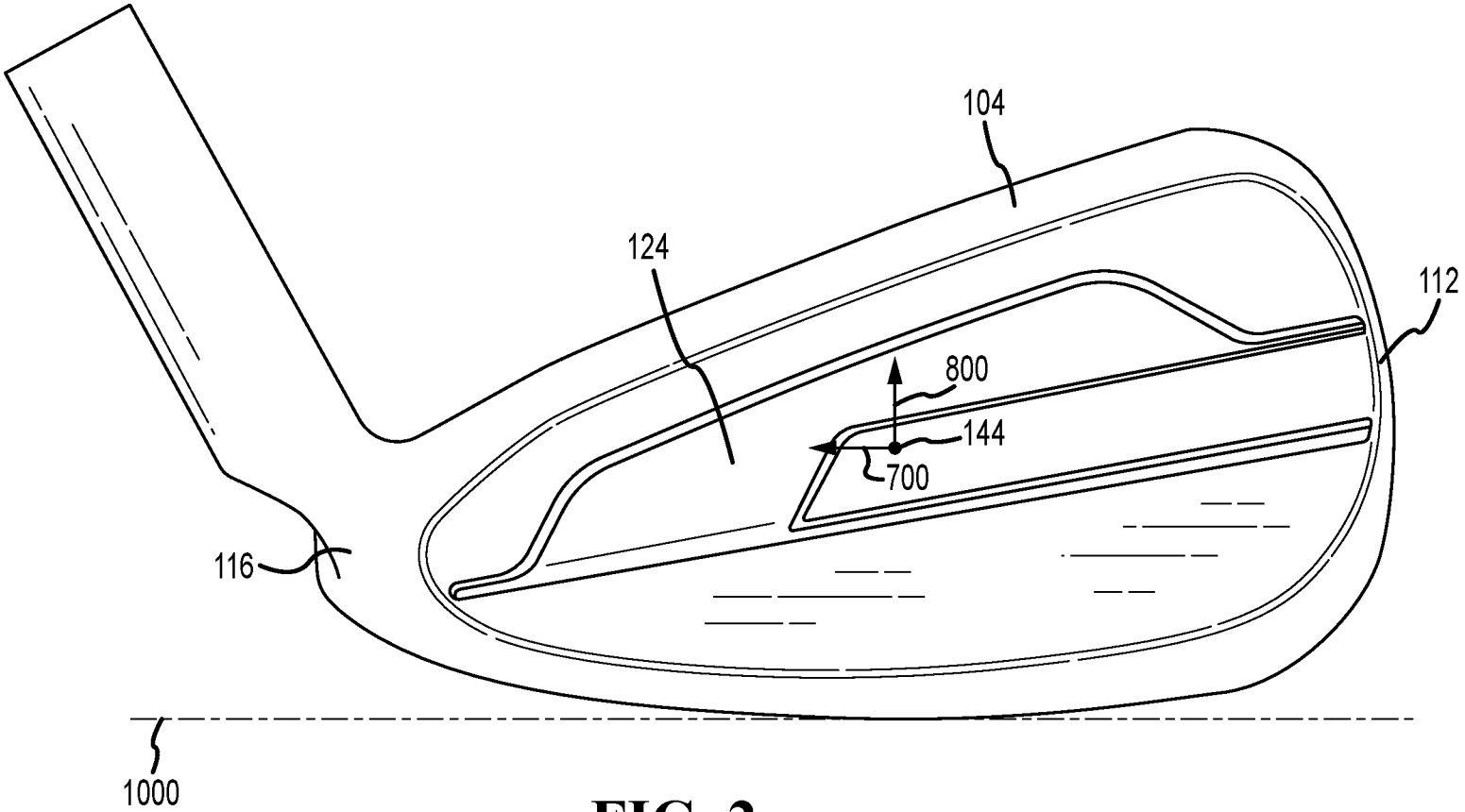
FIG. 2 illustrates a rear view of the club head of FIG. 1.
Figure 3:
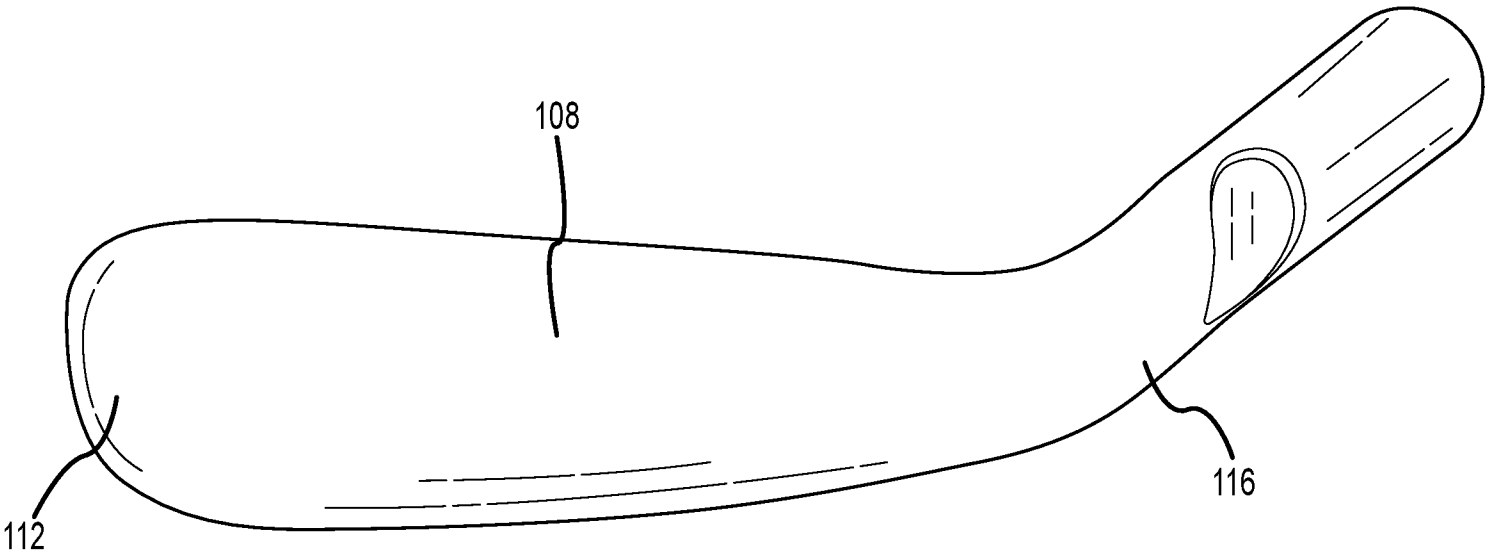
FIG. 3 illustrates a sole view of the club head of FIG. 1.

Referring to FIGS. 1 and 2, the geometric center 144 of the striking surface 132 defines an origin for a coordinate system having an x-axis 700, a y-axis 800, and a z-axis 900. The club head further defines a ground plane 1000 that is tangent to the sole 108 when the club head 100 is at an address position. The x-axis 700 extends through the geometric center 144 from near the heel end 116 to near the toe end 112 in a direction parallel to the ground plane 1000. The y-axis 800 extends through the geometric center 144 from near the sole 108 to near the top rail 104, where the y-axis 800 is perpendicular to the x-axis 700 and to the ground plane 1000. The z-axis 900 extends through the geometric center 144 rearward the striking surface 132 in a direction parallel with the ground plane 1000. The z-axis 900 is perpendicular to the x-axis 700 and the y-axis 800.

The club head 100 defines a loft plane 2000 that is tangent to the striking surface 132. The loft plane 2000 is positioned at an acute angle with respect to the y-axis 800, wherein the acute angle can correspond to the loft angle of the club head 100. The strike face 120 further defines the perimeter 140 that extends entirely around the club head 100. The perimeter 140 of the strike face 120 extends near the top rail 104, the sole 108, the toe end 112, and the heel end 116.

The club head 100 further defines a head depth plane 3000 that extends through the geometric center 144 in a direction perpendicular to the loft plane 2000. The head depth plane 3000 is positioned at an acute angle with respect to the z-axis 900. The head depth plane 3000 extends from near the toe end 112 to near the heel end 116, and extends rearward the strike face 120 or the loft plane 2000.

The strike face 120 comprises a thickness measured from the striking surface 132 to the back surface 136 in a direction extending perpendicular to the loft plane 2000 or striking surface 132. The thickness of the strike face 120 can vary such that a maximum thickness of the strike face 120 can be located near the geometric center 144, and a minimum thickness of the strike face 120 can be located near the perimeter 140. The thickness of the strike face 120 can range from 0.05 to 0.20 inch. In some embodiments, the thickness of the strike face 120 can range from 0.05 to 0.125 inch, or 0.125 to 0.20 inch. In some embodiments, the thickness of the strike face 120 can range from 0.05 to 0.10 inch, 0.06 to 0.11 inch, 0.07 to 0.12 inch, 0.08 to 0.13 inch, 0.09 to 0.14 inch, or 0.10 to 0.15 inch. For example, the thickness of the strike face 120 can be 0.05, 0.06, 0.065, 0.07, 0.075, 0.08, 0.085, 0.09, 0.095, 0.10, 0.11, 0.12, 0.13, 0.14, 0.15, 0.16, 0.17, 0.18, 0.19, or 0.20 inch. In one example, the maximum thickness of the strike face 120 can be 0.097 inch, and the minimum thickness of the strike face 120 can be 0.077 inch.

Filler Material Location for Hollow Body Iron

The hollow body construction of the club head 100 allows for a filler material 148 to be disposed within the cavity 128. The filler material 148 is similar to the filler material described above. The filler material 148 can be disposed or applied to an interior surface 152 of the club head 100. In some embodiments, the filler material 148 can be applied as a paint to the entire interior surface 152 or selected locations of the interior surface 152. In other embodiments, the filler material 148 can be injected into the cavity 128, for example, but not limited to, through a weight port or an opening that allows access to the interior surface 152 of the club head 100 from a point outside the club head 100. The filler material 148 can be injected into the cavity 128 to fill a volume percentage of the cavity 128. The filler material 148 is used to attenuate sound to provide a pleasing sound and feel to the golfer.

Figure 6:
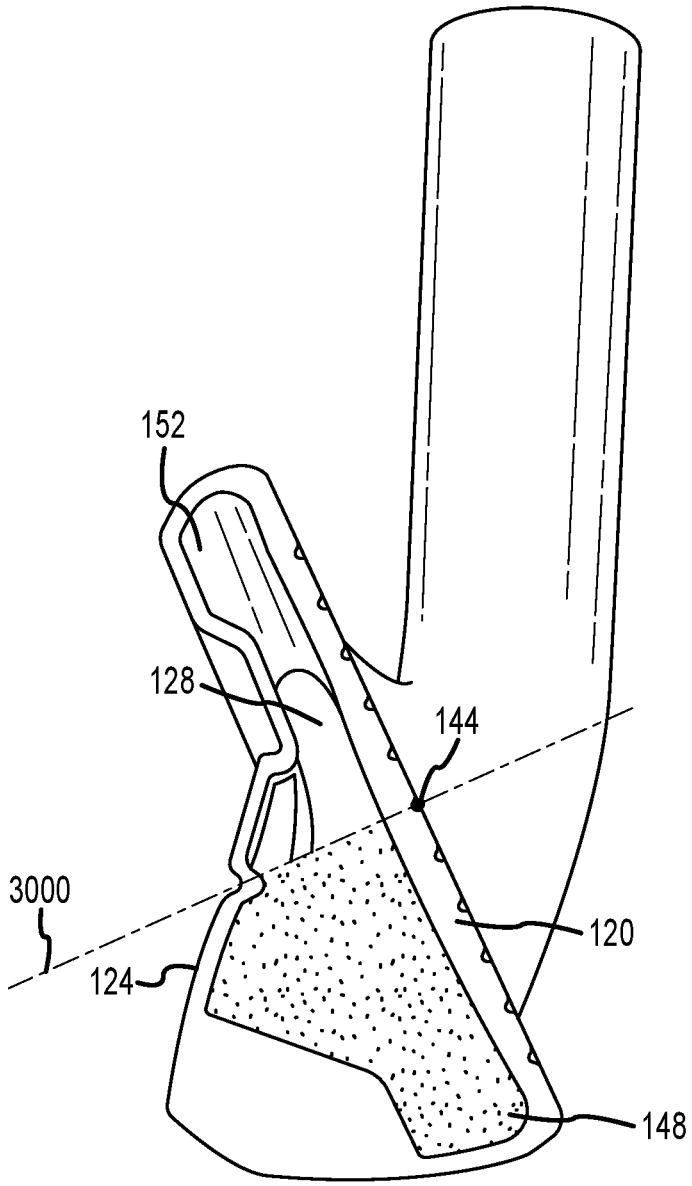
FIG. 6 illustrates a filler material positioned within the club head of FIG. 1 according to an embodiment.
Figure 7:
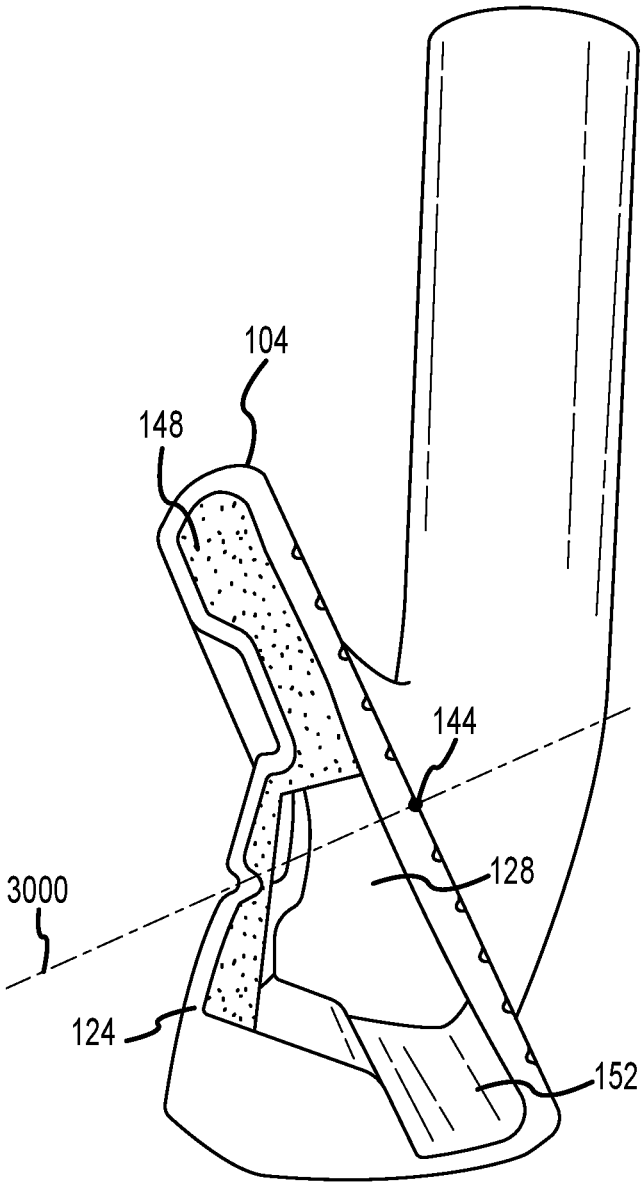
FIG. 7 illustrates a filler material positioned within the club head of FIG. 1 according to another embodiment.

Referring to FIGS. 6 and 7, the filler material 148 can be disposed within the interior volume of the cavity 128. In some embodiments, the cavity 128 can be fully filled with the filler material 148. In other embodiments, the cavity 128 can be partially filled with the filler material 148. The cavity 128 can be filled in relation to the head depth plane 3000. The filler material 148 can be filled below, above, or both below and above the head depth plane 3000. In one example, as illustrated in FIG. 6, the filler material 148 can be filled below the head depth plane 3000. In other embodiments, as illustrated in FIG. 7, the filler material 148 can be filled both above and below the head depth plane 3000 and have regions of the interior surface 152 be devoid of the filler material 148. In the embodiment of FIG. 7, the filler material 148 is devoid from interior surface 152 at the sole 108 and the back surface 136 of the strike face 120 below the head depth plane 3000. In the embodiment of FIG. 6, the filler material 148 is devoid from the interior surface 152 at the top rail 104 and the back surface 136 of the strike face 120 above the head depth plane 3000.

The filler material 148 can occupy less than 75% of the volume of the cavity 128. In some embodiments, the filler material 148 can occupy less than 70%, 65%, 60%, 55%, 50%, 45%, 40%, 35%, 30%, 25%, or 20% of the volume of the cavity 128. The filler material 148 can occupy between 1% to 75% of the volume of the cavity 128. In some embodiments, the filler material 148 can occupy 1% to 50%, or 50% to 75% of the volume of the cavity 128. In some embodiments, the filler material 148 can occupy 5% to 55%, 1% to 60%, 15% to 65%, 20% to 70%, or 25% to 75% of the volume of the cavity 128. In some embodiments, the filler material 148 can occupy 1% to 40%, 5% to 45%, 1% to 50%, 15% to 55%, 20% to 60%, 25% to 65%, 30% to 70%, or 35% to 75% of the volume of the cavity 128. For example, the filler material 148 can occupy 1%, 1%, 15%, 20%, 25%, 30%, 35%, 40%, 45%, 50%, 55%, 60%, 65%, 70%, or 75% of the volume of the cavity 128.

The filler material 148 can be disposed on the interior surface 152 at the top rail 104, the sole 108, the toe end 112, the heel end 116, the rear 124, the strike face 120 (i.e. back surface 136), or a combination thereof. In one example, the filler material 148 can be disposed on the interior surface 152 at the top rail 104 and the back surface 136. In another example, as illustrated in FIG. 7, the filler material 148 can be disposed on the interior surface 152 at the top rail 104, the strike face 120, and the rear 124. In another example still, the filler material 148 can be disposed on the interior surface 152 at the strike face 120 and the toe end 112.

The filler material 148 can be disposed on the interior surface 152 of the club head 100 such that a portion of the strike face 120 can be coupled to a portion of the rear 124 with the filler material 148. The filler material 148 can span across the cavity 128 such that the filler material 148 contacts the interior surface 152 at the strike face 120 and the rear 124. In other embodiments, the filler material 148 can span across the cavity 148 such that the filler material 148 contacts the interior surface 152 at the strike face 120, the top rail 104, the rear 124, the toe end 112, the heel end 116, the sole 108, or a combination thereof. In some embodiments, as illustrated in FIG. 7, the strike face 120, the top rail 104, and the rear 124 can be coupled together with the filler material 148. In some embodiments, as illustrated in FIG. 6, the strike face 120, the sole 108, and the rear 124 can be coupled together with the filler material 148.

The filler material 148 when added to the cavity 128 adds mass to the club head 100. The mass of the filler material 148 can be measured in grams. The mass of the filler material 148 can range from 1 to 20 grams. In some embodiments, the mass of the filler material 148 can range from 1 to 10 grams, or 10 to 20 grams. In some embodiments, the mass of the filler material 148 can range from 1 to 8 grams, 2 to 9 grams, 3 to 10 grams, 4 to 11 grams, 5 to 12 grams, 6 to 13 grams, 7 to 14 grams, 8 to 15 grams, 9 to 16 grams, 10 to 17 grams, 11 to 18 grams, 12 to 19 grams, or 13 to 20 grams. For example, the mass of the filler material 148 can be 1, 2, 3, 4, 5, 5.5, 6, 6.5, 7, 7.5, 8, 8.5, 9, 9.5, 10, 10.5, 11, 11.5, 12, 12.5, 13, 14, 15, 16, 17, 18, 19, or 20 grams.

Figure 8:
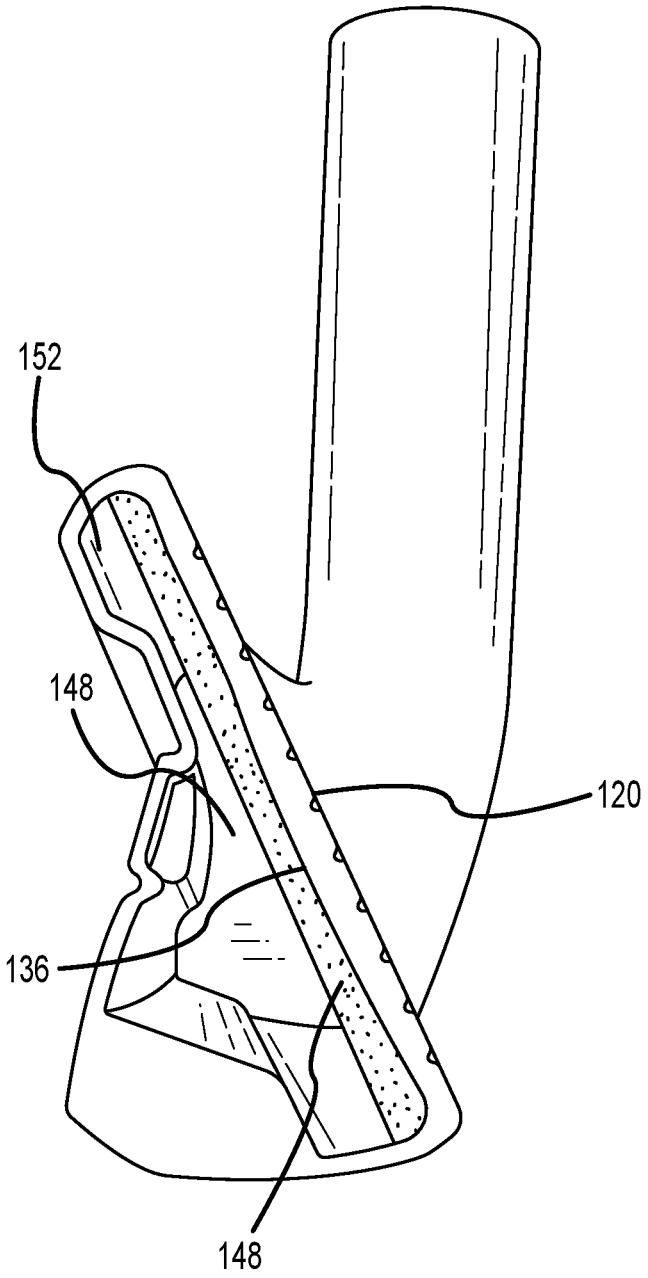
FIG. 8 illustrates a filler material positioned within the club head of FIG. 1 according to another embodiment.
Figure 9:
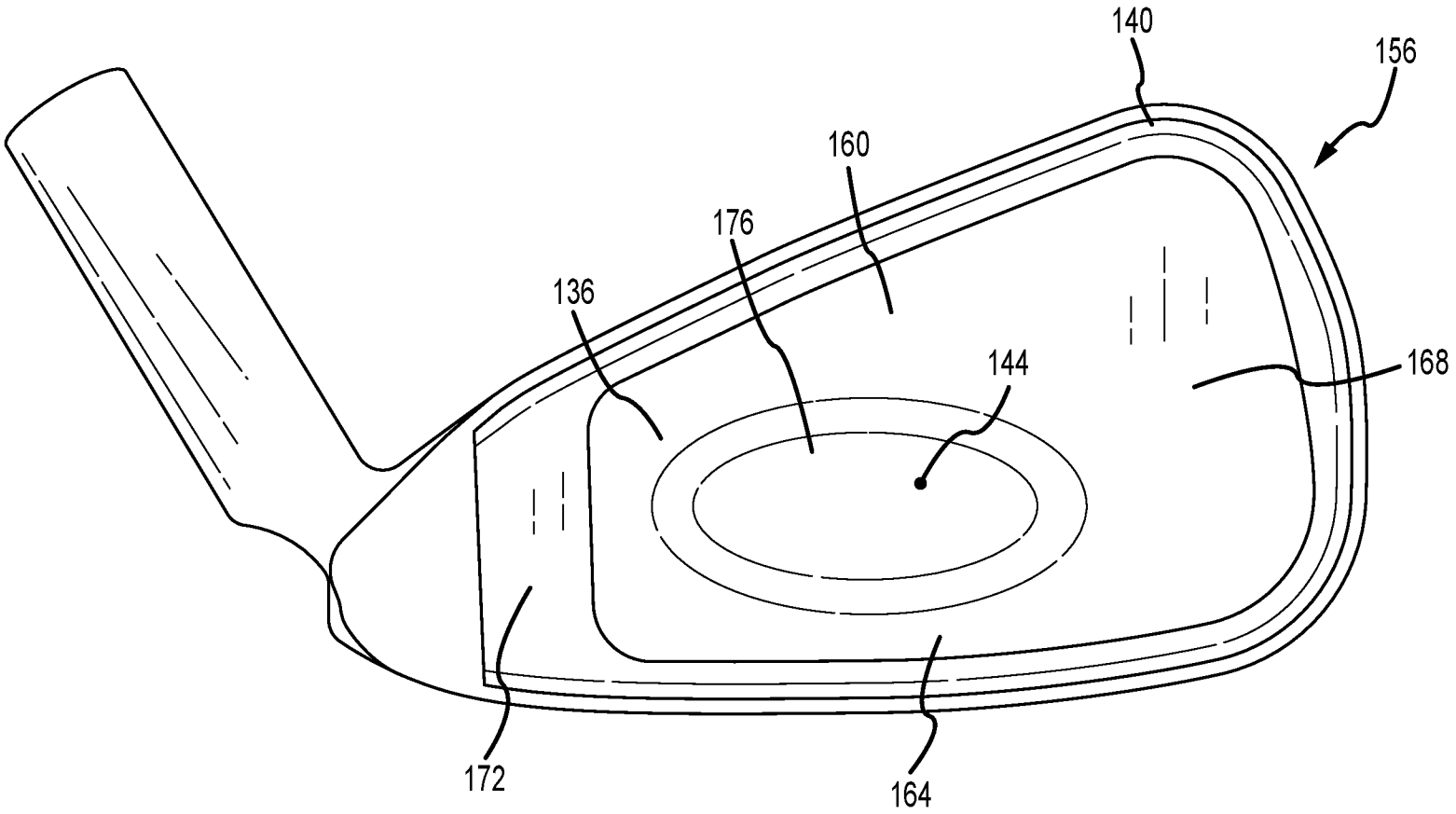
FIG. 9 illustrates a partial cut away view of the club head of FIG. 1.
Figure 10:
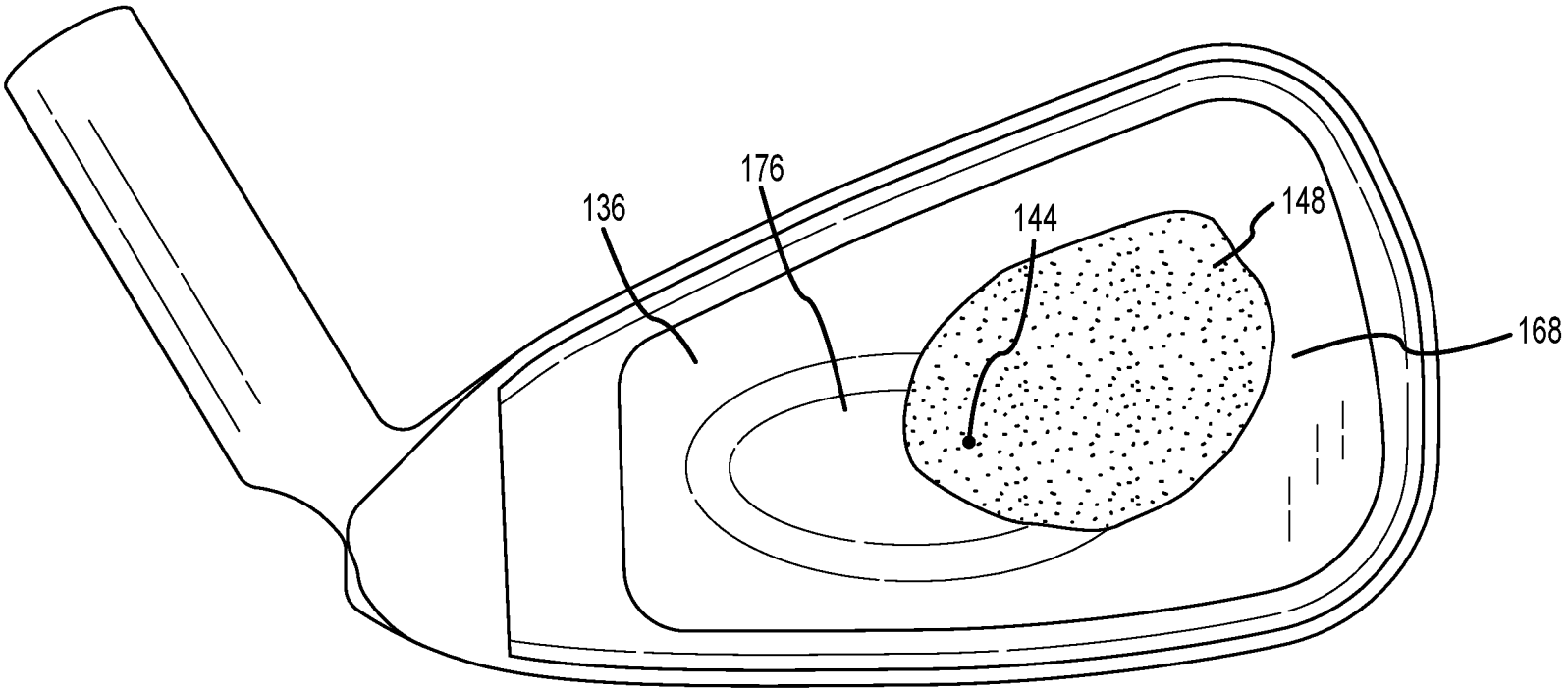
FIG. 10 illustrates a filler material positioned within the club head of FIG. 1 according to another embodiment.

Referring to FIGS. 8-10, the filler material 148 can be disposed on the back face 136 of the strike face 120. In one embodiment, as illustrated in FIG. 8, the filler material 148 can be disposed on the entire back face 136. In other embodiments, the filler material 148 can be disposed at localized regions of the strike face 120. As illustrated in FIG. 9, the strike face 120 comprises one or more regions 156. The one or more regions 156 can comprise a top region 160 located near the top rail 104, a bottom region 164 located near the sole 108, a toe region 168 located near the toe end 112, a heel region 172 located near the heel end 116, and a center region 176 located near and around the geometric center 144.

The filler material 148 can be disposed at the top region 160, the bottom region 164, the toe region 168, the heel region 172, the center region 176, or a combination thereof. In one example, as illustrated in FIG. 10, the filler material 148 can be disposed on the center region 176 and the toe region 168. In another example, the filler material 148 can be disposed on the center region 176, the toe region 168, and the top region 168.

The filler material 148 can comprise a thickness. The thickness of the filler material 148, when disposed on the back surface 136, can be measured in a direction extending perpendicular to the strike face 120 or the loft plane 2000. The thickness of the filler material 148, when disposed on other locations of the interior surface 152, can be measured in a direction extending perpendicular to the interior surface 152 of the club head 100. In some embodiments, the thickness of the filler material 148 can be constant. In some embodiments, the thickness of the filler material 148 can vary.

In some embodiments, the thickness of the filler material 148 can be less than 50% of the thickness of the strike face 120. In some embodiments, the thickness of the filler material 148 can be less than 45%, 40%, 35%, 30%, 25%, 20%, 15%, 10%, or 5% of the thickness of the strike face 120. In other embodiments, the thickness of the filler material 148 can range from 0.01 to 0.20 inch. In some embodiments, the thickness of the filler material 148 can range 0.01 to 0.10 inch, or 0.10 to 0.20 inch. In some embodiments, the thickness of the filler material 148 can range from 0.01 to 0.05 inch, 0.02 to 0.07 inch, 0.03 to 0.08 inch, 0.04 to 0.09 inch, 0.05 to 0.10 inch, 0.06 to 0.11 inch, 0.07 to 0.12 inch, 0.08 to 0.13 inch, 0.09 to 0.14 inch, 0.10 to 0.15 inch, 0.11 to 0.16 inch, 0.12 to 0.17 inch, 0.13 to 0.18 inch, 0.14 to 0.19 inch, or 0.15 to 0.20 inch. For example, the thickness of the filler material 148 can be 0.01, 0.02, 0.03, 0.035, 0.04, 0.045, 0.05, 0.055, 0.06, 0.065, 0.07, 0.075, 0.08, 0.085, 0.09, 0.095, 0.1, 0.11, 0.12, 0.13, 0.14, 0.15, 0.16, 0.17, 0.18, 0.19, or 0.20 inch.

Driver Club Head

Figure 11:
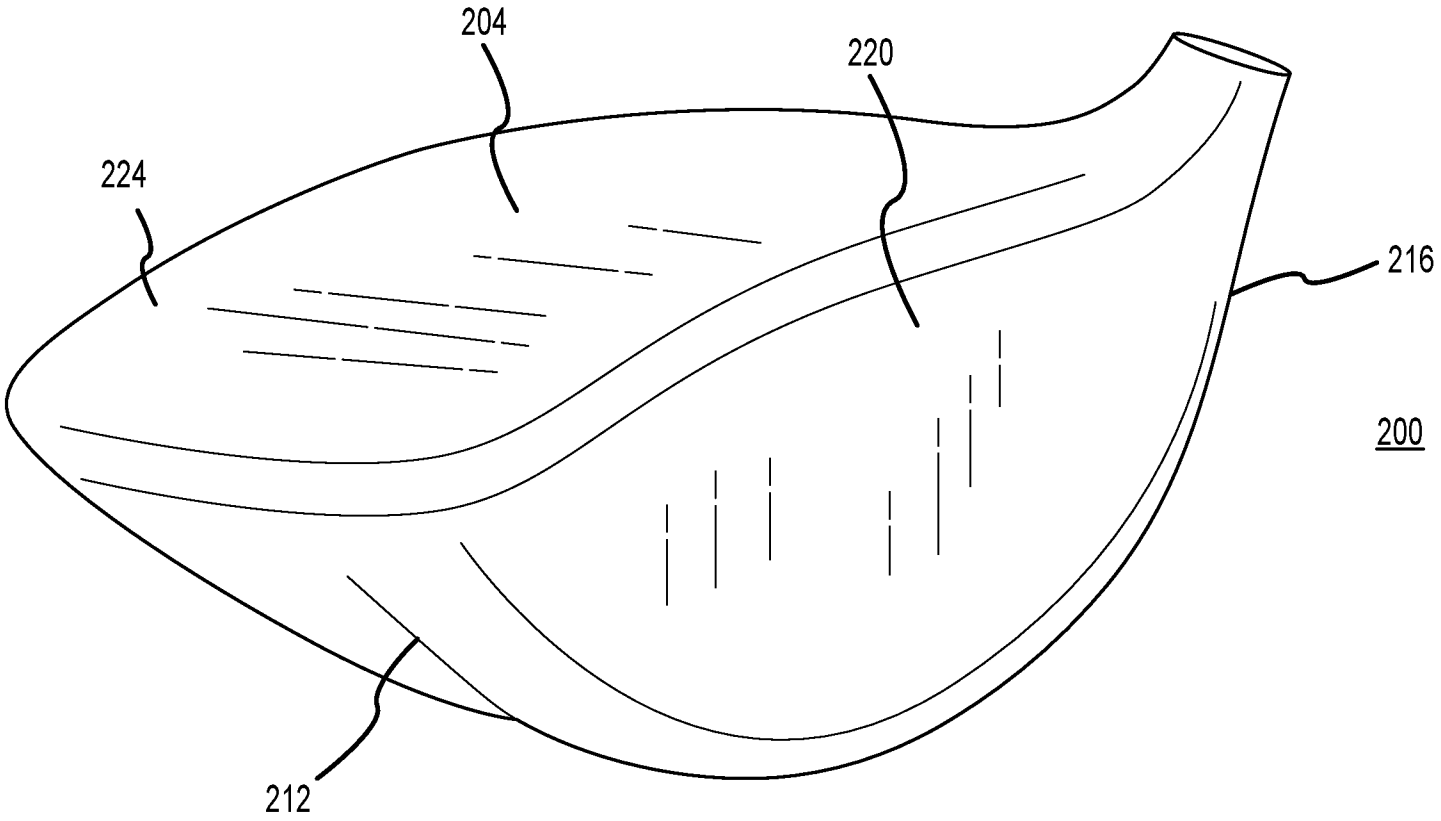
FIG. 11 illustrates a front perspective view of a golf club head according to another embodiment.

Referring to FIGS. 11-15, wherein like reference numerals are used to identify like or identical components in various, FIGS. 11-15 schematically illustrate a second embodiment of the present design. Specifically, FIG. 11 illustrates a front perspective view of a driver-type club head 200. The club head 200 comprises a body 202 having a crown 204, a sole 208 opposite the crown 204, a toe 212, and a heel 216 opposite the toe 212. The club head 200 further includes a strike face 220 and a rear 224 opposite the strike face 220. The strike face 220 and the body 202 can be secured together to form a closed/hollow interior volume. The closed/hollow interior volume defines a cavity 228.

Figure 12:
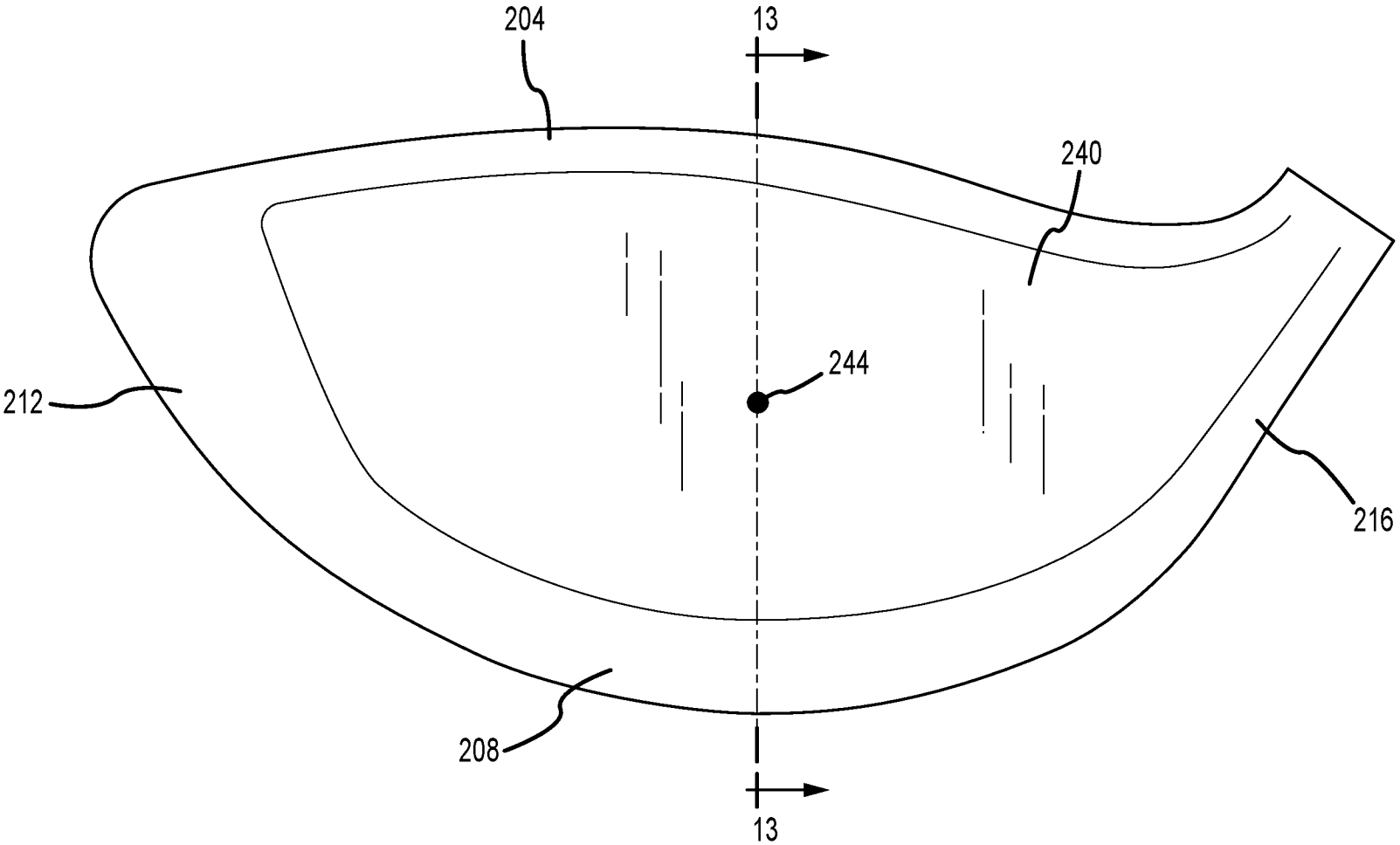
FIG. 12 illustrates a front view of the club head of FIG. 11.

Referring to FIGS. 11 and 12, the strike face 220 of the club head 200 comprises a striking surface 232 intended to impact a golf ball, and a back surface 236 opposite the striking surface 232. The striking surface 232 further defines a geometric center 244. As described above, the method to determine the location of the geometric center 244 for the club head 200 can be similar to the method to determine the location of the geometric center 144 for the club head 100. The strike face 220 further defines a perimeter 240 that extends entirely around the striking surface 232. The perimeter 240 of the strike face 220 extends near the crown 204, the sole 208, the toe 212, and the heel 216.

Figure 13:
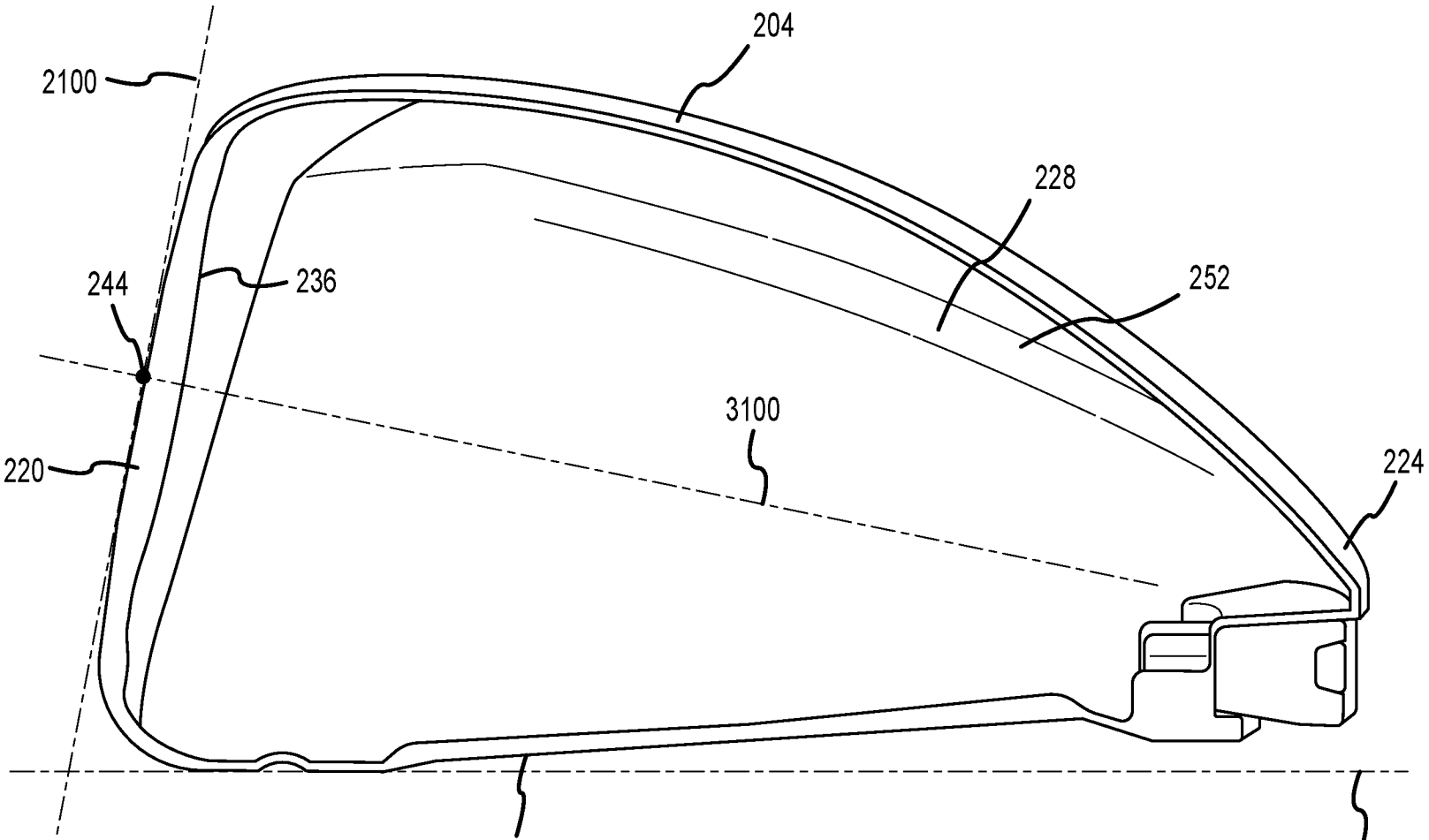
FIG. 13 illustrates a cross sectional view of the club head of FIG. 11 taken at line 13-13 of FIG. 12.

Referring to FIGS. 12 and 13, the geometric center 244 of the club head 200 defines an origin for a coordinate system similar to the coordinate system described above for the club head 100. The club head 200 defines a ground plane 1100 that is tangent to the sole 208 when the club head 200 is at an address position. The club head 200 defines a loft plane 2100 that is tangent to the striking surface 232. The club head 200 further defines a head depth plane 3100 that extends through the geometric center 244. The head depth plane 300 extends from near the toe 212 to near the heel 216, and extends rearward the strike face 220 or the loft plane 2000. The loft plane 2100 and the head depth plane 3100 of the club head 200 can be positioned in relation to the coordinate system similar to the loft plane 2000 and the head depth plane 3000 of the club head 100 as described above.

The strike face 220 comprises a thickness measured from the striking surface 232 to the back surface 236 in a direction extending perpendicular to the loft plane 2000 or striking surface 232. The thickness of the strike face 220 can vary such that a maximum thickness of the strike face 220 can be located near the geometric center 244, and a minimum thickness of the strike face 220 can be located near the perimeter 240. The thickness of the strike face 220 can range from 0.08 to 0.20 inch. In some embodiments, the thickness of the strike face 220 can range from 0.08 to 0.14 inch, or 0.14 to 0.20 inch. In some embodiments, the thickness of the strike face 220 can range from 0.08 to 0.13 inch, 0.085 to 0.135 inch, 0.09 to 0.14 inch, 0.095 to 0.145 inch, 0.10 to 0.15 inch, or 0.11 to 0.16 inch. For example, the thickness of the strike face 220 can be 0.08, 0.085, 0.09, 0.095, 0.10, 0.105, 0.11, 0.12, 0.13, 0.14, 0.15, 0.16, 0.17, 0.18, 0.19, or 0.20 inch.

Filler Material Location for Driver

The hollow body construction of club head 200 allows for a filler material 248 to be disposed within the cavity 228. The filler material 248 can be similar to the filler material 148 described above. The filler material 248 can be disposed or applied to an interior surface 252 of the club head 200. In some embodiments, the filler material 248 can be applied as a paint to the entire interior surface 252 or selected locations of the interior surface 252. In other embodiments, the filler material 248 can be injected into the cavity 228, for example, but not limited to, through a weight port or an opening that allows access to the interior surface 252 from a point outside of the club head 200. The filler material 248 is used to control the regions on the club head 200 that experience the highest vibration amplitudes. The filler material 248 is used to attenuate sound to provide a pleasing sound and feel to the golfer.

Figure 14:
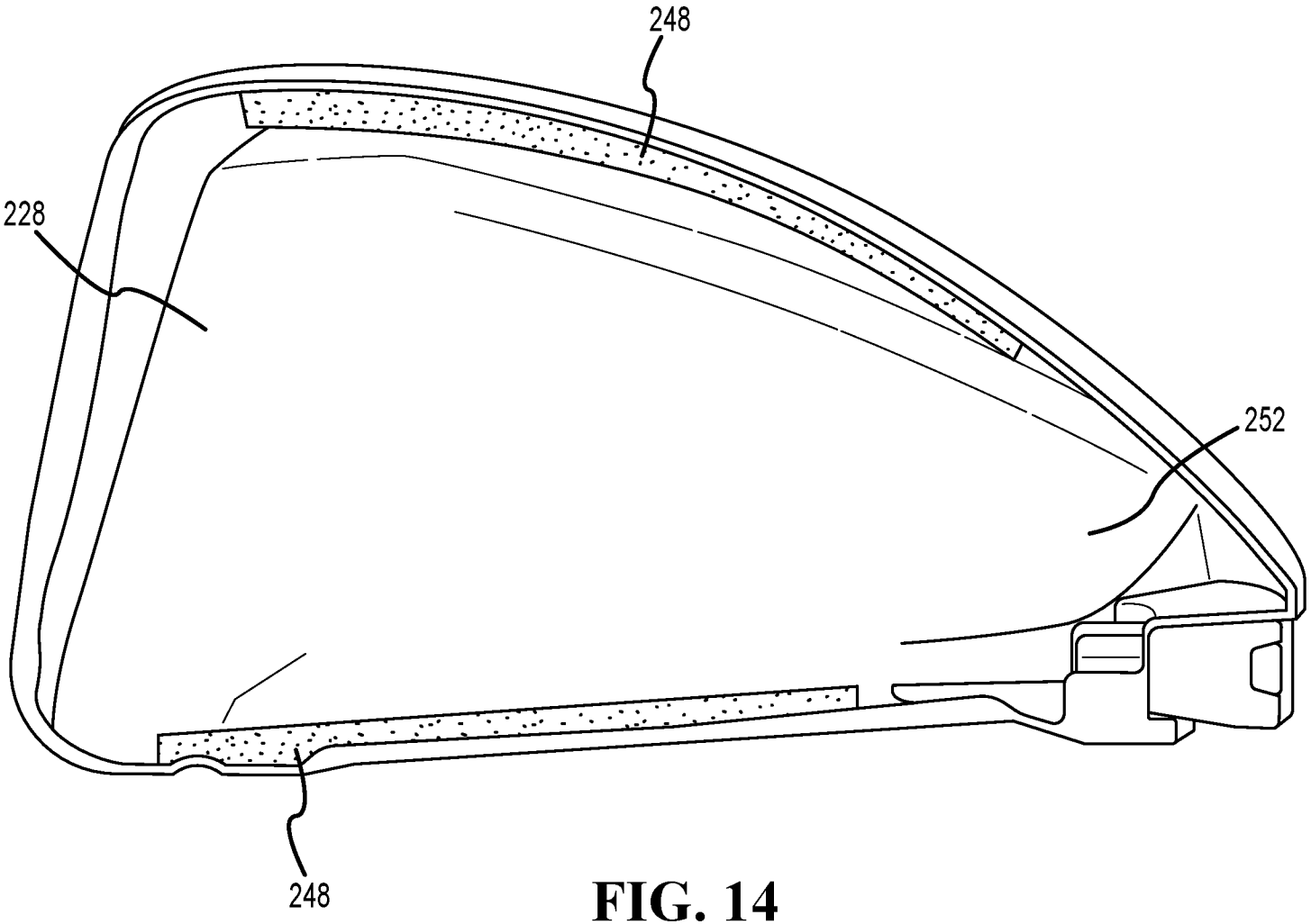
FIG. 14 illustrates a filler material positioned within the club head of FIG. 11 according to an embodiment.
Figure 15:
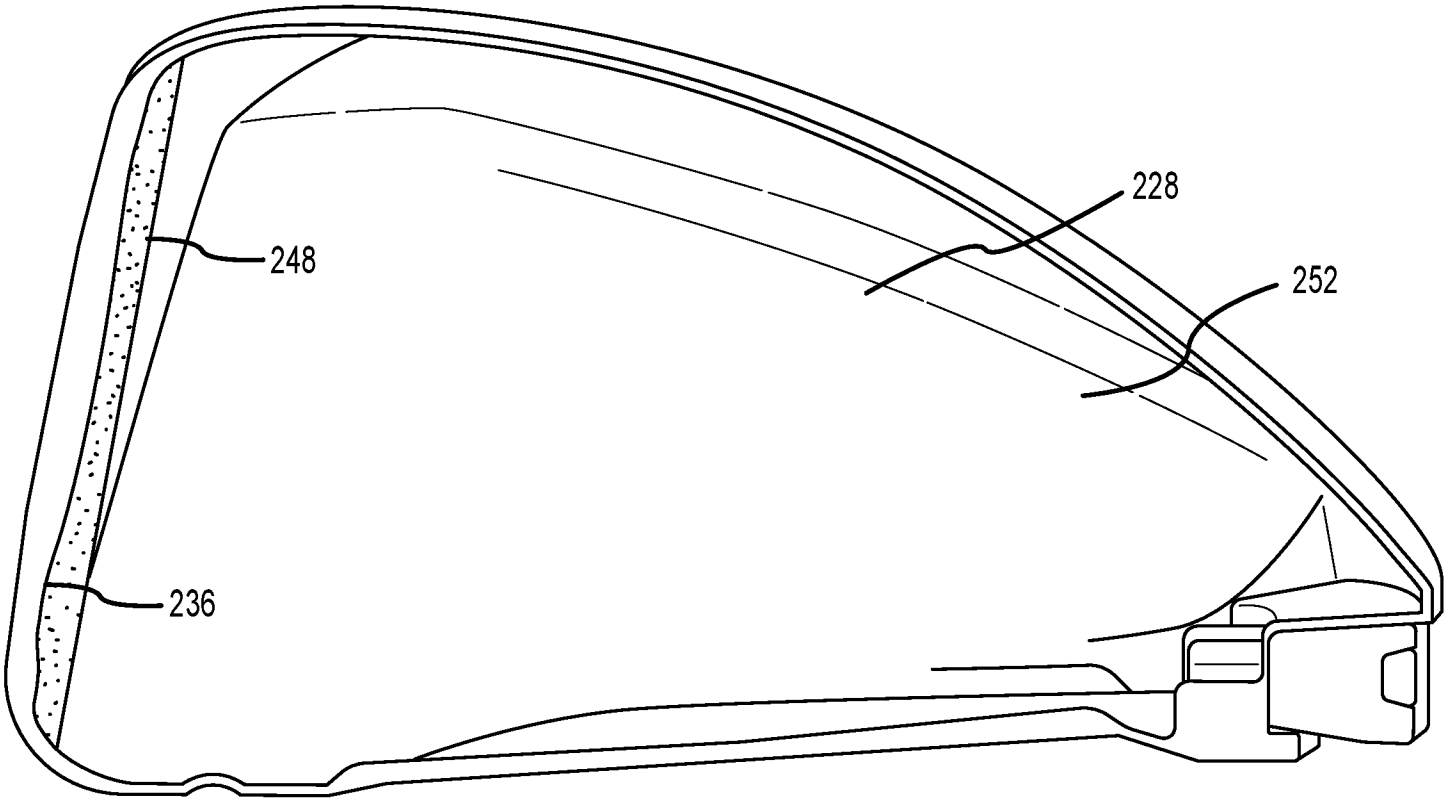
FIG. 15 illustrates a filler material positioned within the club head of FIG. 11 according to another embodiment.

Referring to FIGS. 14 and 15, the filler material 248 can be disposed within the interior volume of the cavity 228. Specifically, the filler material 248 can be disposed on the interior surface 252 of the club head 200. The filler material 248 can be disposed on the interior surface 252 at the crown 204, the sole 208, the toe 212, the heel 216, the rear 224, the strike face 220 (i.e. back surface 236), or a combination thereof. In one example, as illustrated in FIG. 14, the filler material 248 can be disposed on the interior surface 252 at the crown 204 and the sole 208. In another example, the filler material 248 can be disposed on the interior surface 152 at the crown 204 and the strike face 220. In another example, the filler material 248 can be disposed on the interior surface 252 at the crown 204, the strike face 220, and the sole 208. In another example still, the filler material 248 can be disposed on the interior surface 252 at the strike face 220 and the toe 212.

The filler material 248 can be disposed on the interior surface 252 of the club head 200 such that a portion of the strike face 220 can be coupled to a portion of the crown 204 or sole 208 with the filler material 148. In some embodiments, the filler material 248 can be applied to the interior surface 252 such that the filler material 248 contacts the interior surface 252 at the strike face 220 and the crown 204 thereby coupling the strike face 220 and the crown 204 together. In other embodiments, the filler material 248 can be applied to the interior surface 252 such that the filler material 248 contacts the interior surface 252 at the strike face 220 and the sole 208 thereby coupling the strike face 220 and the sole 208 together. In other embodiments still, the filler material 248 can be applied to the interior surface 252 such that the filler material 248 contacts the interior surface 252 at the strike face 220, the crown 204, and the sole 208 thereby coupling the strike face 120, the crown 204, and the sole 208 together. In other embodiments still, the filler material 248 can be applied to the interior surface 252 such that the filler material 248 contacts the crown 204, the sole 208, the toe 212, the heel 216, the strike face 220, the rear 224, or a combination thereof.

Further, the filler material 248 can be disposed within the cavity 228 in relation to the head depth plane 3100. The filler material 248 can be disposed below, above, or both below and above the head depth plane 3100. In one example, the filler material 248 can be filled below the head depth plane 3100. In another example, the filler material 248 can be disposed above the head depth plane 3100. In another example still, as illustrated in FIG. 14, the filler material 248 can be disposed both above and below the head depth plane 3100.

Referring to FIG. 15, the filler material 248 can be disposed on the back face 236 of the strike face 220. In one embodiment, the filler material 248 can be disposed on the entire back face 236. In other embodiments, the filler material 248 can be disposed at localized regions of the strike face 220. The strike face 220 can comprise one or more regions (not illustrated) similar to the one or more strike face regions 156 described above. The one or more regions of the strike face 220 can comprise a top region located near the crown 204, a bottom region located near the sole 208, a toe region located near the toe 212, a heel region located near the heel 216, and a center region located near and around the geometric center 244.

The filler material 248 can be disposed at the top region, the bottom region, the toe region, the heel region, the center region, or a combination thereof. In one example, the filler material 248 can be disposed on the center region and the toe region. In another example, the filler material 248 can be disposed on the center region, the toe region, and the top region. In another example, the filler material 248 can be disposed on the center region, the toe region, and the bottom region.

The filler material 248 can comprise a thickness. When the filler material 248 is disposed on the back surface 236, the thickness of the filler material 248 is measured in a direction extending perpendicular to the strike face 220 or the loft plane 2100. When the filler material 248 is disposed on the interior surface of the body 202, the thickness of the filler material 248 is measured in a direction extending perpendicular to the interior surface 252. In some embodiments, the thickness of the filler material 248 can be constant. In some embodiments, the thickness of the filler material 248 can vary.

In some embodiments, the thickness of the filler material 248 can be less than 50% of the thickness of the strike face 220. In some embodiments, the thickness of the filler material 248 can be less than 45%, 40%, 35%, 30%, 25%, 20%, 15%, 10%, or 5% of the thickness of the strike face 220. In other embodiments, the thickness of the filler material 248 can range from 0.01 to 0.10 inch. In some embodiments, the thickness of the filler material 248 can range 0.01 to 0.05 inch, or 0.05 to 0.10 inch. In some embodiments, the thickness of the filler material 248 can range from 0.01 to 0.04 inch, 0.02 to 0.05 inch, 0.03 to 0.06 inch, 0.04 to 0.07 inch, 0.05 to 0.08 inch, 0.06 to 0.09 inch, or 0.07 to 0.10 inch. For example, the thickness of the filler material 248 can be 0.01, 0.02, 0.03, 0.035, 0.04, 0.045, 0.05, 0.055, 0.06, 0.065, 0.07, 0.075, 0.08, 0.085, 0.09, 0.095, or 0.1 inch.

Method of Manufacturing

In some embodiments, a method for forming the club head 100 can comprise forming a body 102, forming a strike face 120, and securing the strike face 120 to the body 102. In other embodiments, a method for forming the club head 200 can comprise forming the strike face 120 and the body 102 integrally. In many embodiments, forming the club head 100 can consist of casting, 3D printing, machining, or any other suitable method for forming the club head 100.

In many embodiments, forming the strike face 120 can consist of machining, 3D printing, casting, or any suitable method for forming the strike face 120. In many embodiments, securing the strike face 120 to the body 102 can be accomplished by welding, mechanical fastening, or any other suitable method of securing the strike face 120 to the body 102.

In many embodiments, a method for forming the club head 200 can be similar to the method for forming the club head 100. Specifically, forming the club head 200 can comprise forming a body 202, forming a strike face 220, and securing the strike face 220 to the body 202. In some embodiments, the body 202 can be formed as a unitary body. In other embodiments, the body 202 can be formed of a plurality of bodies that are secured together to form the body 202.

In many embodiments, a method for forming the filler material 148 or 248 described in this disclosure can comprise forming the carrier, and mixing the filler and carrier together to form a heterogenous mixture. After thoroughly mixing the filler and the carrier together, the filler material 148 or 248 is disposed, affixed, bonded, or filled within the interior volume of the club head 100 or 200. In some embodiments, the filler material 148 or 248 can be injected into the club head 100 or 200 through a weight port or an opening that allows access to the interior volume of the club head 100 or 200. The club head 100 or 200 can be oriented to allow the filler material 148 or 248 to bond to a selected location within the interior volume.

When the filler material is disposed, affixed, or filled within the interior volume of the club head 100 or 200, the filler material is cured at room temperature (e.g. approximately 70 degrees Fahrenheit) to allow the filler material to bond to the club head 100 or 200. In other embodiments, the filler material is cured with a heated source such as an oven or a heated lamp to allow the filler material to bond to the club head 100 or 200.

The club head 100 or 200 may be formed from a metal. Examples of metals may include, for example, but not limited to, steel, steel alloy, stainless steel, stainless steel alloy, C300, C350, Ni (Nickel)-Co(Cobalt)-Cr(Chromium)-Steel Alloy, 8620 alloy steel, S25C steel, 303 SS, 17-4 SS, carbon steel, maraging steel, 565 Steel, AISI type 304 or AISI type 630 stainless steel, titanium alloy, Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 titanium alloy, amorphous metal alloy, or other similar metals.

Benefits

Figure 16:
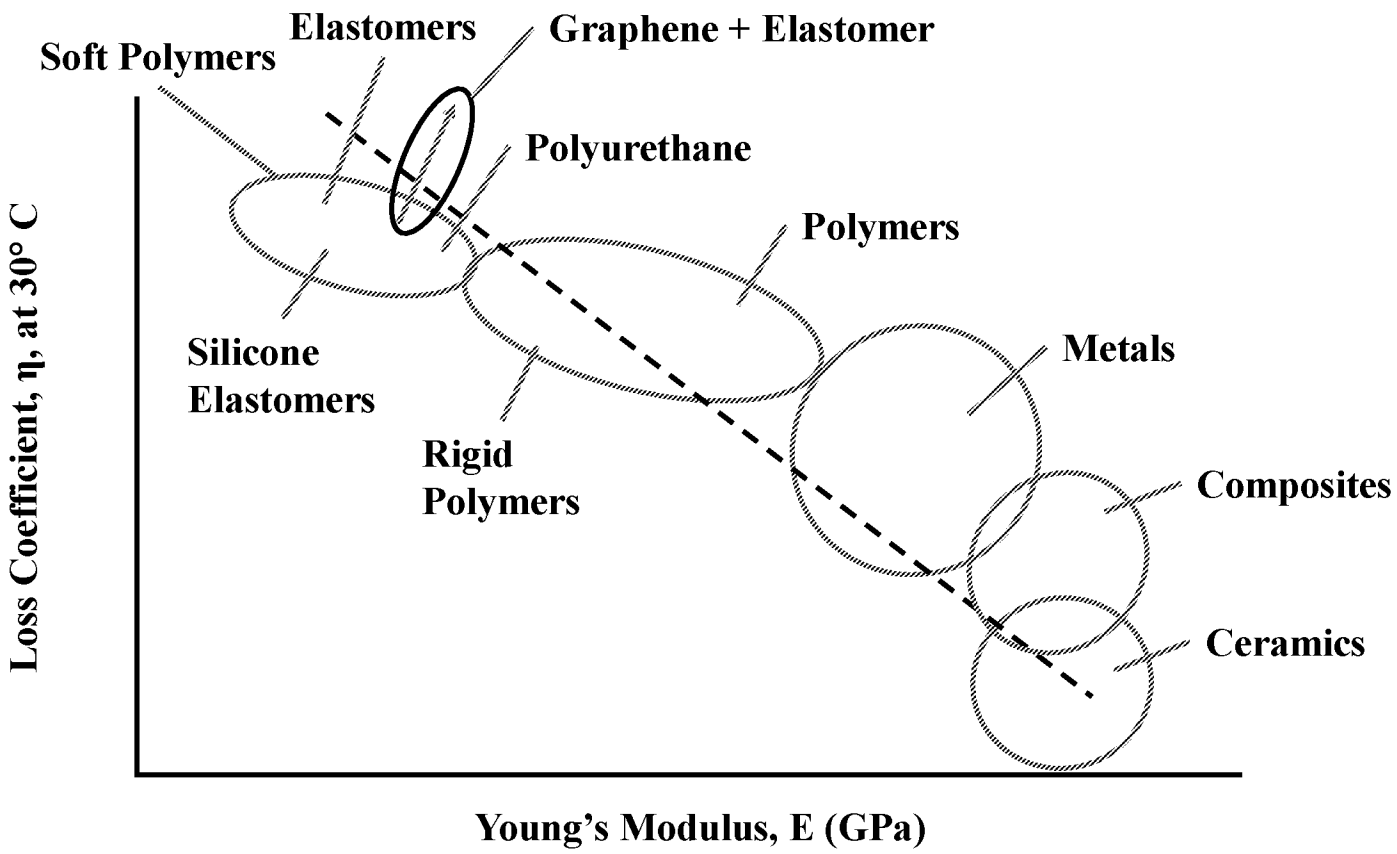
FIG. 16 illustrates a graph of a loss coefficient as a function of young's modules for various materials.

The filler material 148 comprising the nanocomposite including the graphene and the polymer provides a soft material with high damping properties and low stiffness compared to traditional non-composite materials such as homogeneous polymers. An Ashby chart can be used to qualitatively identify damping and stiffness properties for various materials. In one example, as illustrated in FIG. 16, an Ashby chart can be used to qualitatively illustrate a loss coefficient or damping (hereafter "damping") as a function of young's modules or stiffness (hereafter "stiffness") for various materials. Damping refers to the material's ability to minimize the vibration amplitude from vibrational forces (i.e. sound attention). Stiffness refers to the material's ability to resist deformation in response to applied forces (i.e. vibrational forces). Various materials such as polymers, elastomers, metals, composites, ceramics are illustrated in FIG. 16. The Ashby chart shows a general trend that polymers have high damping properties and less stiffness, and metals, composites, and ceramics have low damping properties and greater stiffness.

Referring to FIG. 16, adding graphene to an elastomer qualitatively increases the stiffness and the damping properties of the nanocomposite. The Young's modulus increases, and the loss coefficient increases. Increasing the stiffness and the damping properties allows the nanocomposite to comprise greater damping properties than most known materials. The greater damping properties of the nanocomposite having the graphene powder and elastomer is highly desirable in attenuating sound of the golf club after golf ball impacts. Further, on the molecular level, the nanocomposite comprises a large surface area per volume ratio that increases the ability to absorb and dissipate the sound within the nanocomposite.

The filler material 148 comprising the nanocomposite including graphene and the polymer allows for a material that does not add a significant amount of mass to the club head while attenuating the sound of the club head during golf ball impacts. To attenuate the sound of the club head, the filler material 148 can be positioned on locations of the club head that see the highest vibration amplitudes (i.e. vibration hot spots). To identify these vibration hot spots, finite element simulations and/or sound tests can be used to measure the club head as a function of amplitude vs. frequency. The simulations and/or sound tests identify multiple modes of frequency that correspond to a type of sinusoidal shape. Each mode of frequency can occur in different portions of the club head or overlap with other modes of frequency. The locations of the club head with the highest vibration amplitude are added to together to identify a single vibration hot spot across multiple modes of frequency. The filler material 148 can be applied to this single vibration hot spot to minimize the amplitude at or around the vibration hot spot. For example, using a finite element simulation, the vibration hot spots were identified on the strike face 120, the top rail 104, and the rear 124 of the club head 100 across multiple modes of frequency. The vibration hot spots were added together to identify a single location that spanned the strike face 120, the top rail 104, and the rear 124. As illustrated in FIG. 7, the filler material 148 was added to this single vibration hot spot to attenuate the sound of the club head 100 during golf ball impacts.

The filler material 148 comprising the nanocomposite including graphene and the polymer allows for an alternative material that attenuates sound just as well as homogenous materials, or composite materials. As described in the example below, the club head 100 comprising the nanocomposite performed just as well as a club head comprising a homogenous polyurethane, and a club head comprising a composite with respect to ball speed, ball spin, and launch angle. The club head comprising the composite includes ethylene vinyl acetate (EVA), a hydrocarbon such as paraffin wax, a resin tackifier (i.e. a material that increases the tack or the stickiness of the composite material), and other additives to decrease the hardness of the composite material or increase the melting point of the composite material. The filler material comprising the nanocomposite provides an alternative material to attenuate sound for hollow body club heads and provide a pleasing club head sound and feel to the golfer.

EXAMPLES

Example 1

Club Head Performance Comparison

An exemplary hollow body iron club head 100 was compared to two similar control hollow body iron club heads. The exemplary club head 100 comprised a nanocomposite including graphene and a polyurethane. The first control club head comprised a homogenous polyurethane, and the second control club head comprised a composite including an ethylene vinyl acetate (EVA), a paraffin wax, a resin tackier, and hardness reducing additives. Each of the exemplary club head 100, the first control club head, and the second control club head included 5 grams of their respective filler materials disposed behind the strike face.

A test was conducted to compare the ball speed, ball spin, and the launch angle between the exemplary club head 100, the first control club head, and the second control club head. The test entailed measuring the ball speed and the ball spin imparted from the strike face for each club head, and the launch angle for each club head while keeping head dimensions, loft angle, swing weighting, club head weight, shaft properties, and weather conditions constant throughout the test.

The test resulted in the exemplary club head 100 averaging a ball speed of 132.2 mph, a ball spin of 5683 rpm, and a launch angle of 14 degrees. The test resulted in the first control club head averaging a ball speed of 132.1 mph, a ball spin of 5721 rpm, and a launch angle of 13.7 degrees. The test resulted in the second control club head averaging a ball speed of 132.1 mph, a ball spin of 5663 rpm, and a launch angle of 13.8 degrees. The results show that the exemplary club head 100 had similar ball speed, ball spin, and launch angle performance compared to the first and second control club head. The exemplary club head 100 comprising graphene and the polyurethane nanocomposite provides an alternative material that performs just as well as the homogenous polymer or the composite material.

Example 2

Identification of Regions with Highest Vibration Amplitude

A modal analysis using finite element analysis software was conducted on an exemplary hollow body iron club head 100. The modal analysis was used to identify the modes of frequency that comprised a large vibratory response. The modal analysis was used to identify the large vibratory response locations on the club head 100. The modal analysis measured power (watts) vs. frequency (Hertz) of the club head 100 during an applied vibrational force. The power corresponds to the vibratory response (e.g. vibration amplitude) of the club head 100 during the applied vibrational force. The frequency corresponds to a specific rate of oscillatory motion.

Figure 17A:
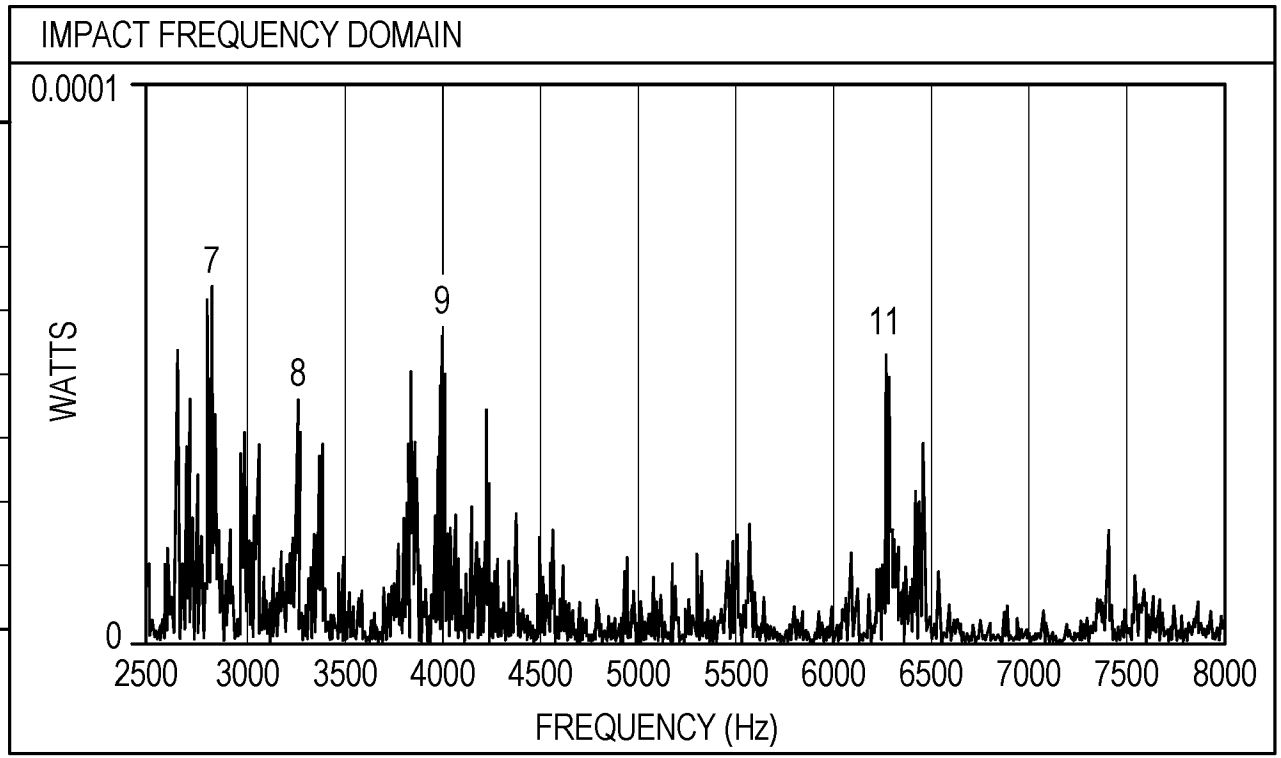
FIG. 17A illustrates modes of frequency for the golf club head of FIG. 1 during a modal analysis.

Referring to FIGS. 17A-17E, the modal analysis identified modes of frequency with a large vibratory response. As illustrated in FIG. 17A, the club head 100 experienced a large vibratory response 180 at mode 7 (2811 Hertz), mode 8 (3227 Hertz), mode 9 (4009 Hertz), and mode 11 (6124

Figure 17C:
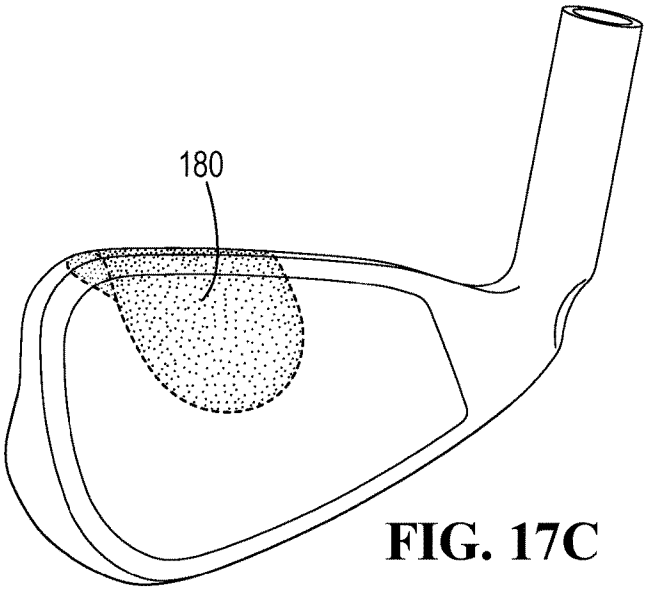
FIG. 17C illustrates a front perspective view of the club head of FIG. 1 showing a vibratory response during a modal analysis.
Figure 17E:
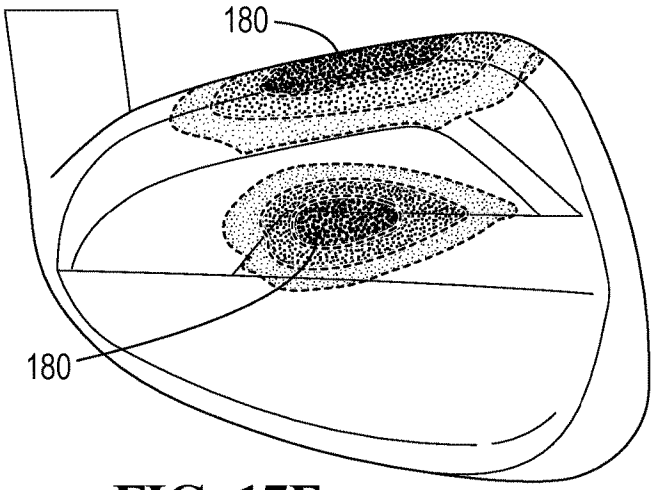
FIG. 17E illustrates a rear perspective view of the club head of FIG. 1 showing a vibratory response during a modal analysis.
Figure 17B:
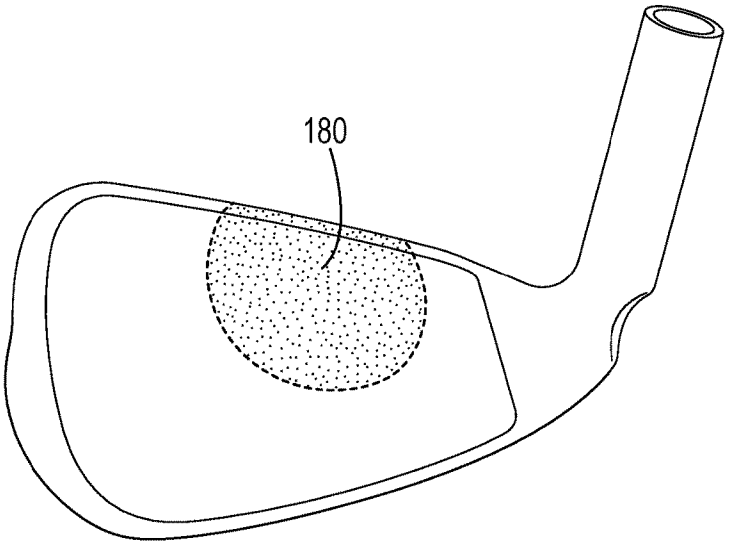
FIG. 17B illustrates a front perspective view of the club head of FIG. 1 showing a vibratory response during a modal analysis.
Figure 17D:
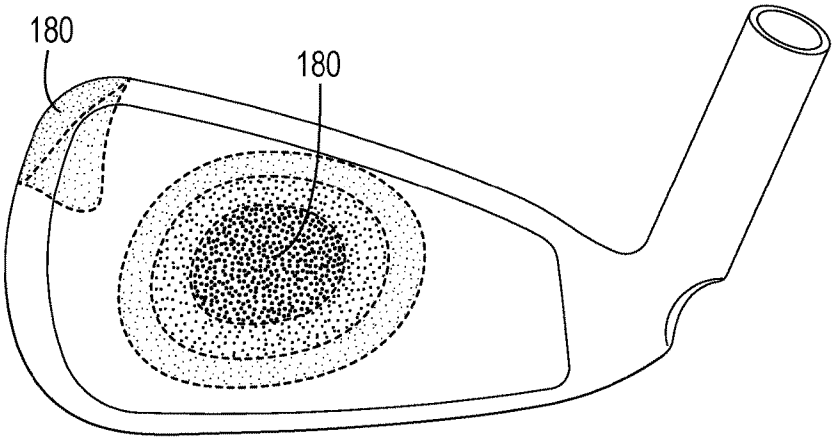
FIG. 17D illustrates a front view of the club head of FIG. 1 showing a vibratory response during a modal analysis.

Hertz). The large vibratory response 180 can occur at different locations on the club head 100. As illustrated in FIG. 17B, the vibratory response 180 occurs at the strike face, the top rail, and the rear near the heel end for mode 7 (2811 Hertz). As illustrated in FIG. 17C, the vibratory response 180 occurs at the strike face, the top rail, and the rear near the toe end for mode 8 (3227 Hertz). As illustrated in FIG. 17D, the vibratory response 180 occurs centrally on the strike face, the toe end, and the rear for mode 9 (4009 Hertz). As illustrated in FIG. 17E, the vibratory response 180 occurs at the top rail and the rear for mode 11 (6124 Hertz). In one example, to minimize the vibratory response 180 of the club head 100 at modes 7, 8, 9, and 11, the filler material comprising the nanocomposite having graphene and the polymer can be applied to the interior surface at the strike face, the top rail, and the rear of the club head 100 as illustrated in FIG. 7. The filler material minimizes the vibratory response 180 at the strike face, the top rail, and the rear thereby controlling the vibration to provide a pleasing sound and feel after the golf ball impact.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club head comprising: a strike face; a top rail; a sole; a toe end; a heel end; and a rear opposite the strike face; wherein the strike face, the top rail, the sole, the toe end, the heel end, and the rear together form a cavity; wherein the cavity is at least partially filled with a nanocomposite; wherein the nanocomposite comprises a graphene powder and a polymer; and wherein the nanocomposite fills less than 50% of a volume of the cavity.

Clause 2. The golf club head of clause 1, wherein the nanocomposite fills less than 40% of the volume of the cavity.

Clause 3. The golf club head of clause 1, wherein the nanocomposite is disposed on a region of the strike face selected from the group consisting of a top region, a bottom region, a heel region, a toe region, and a center region.

Clause 4. The golf club head of clause 1, wherein the nanocomposite comprises a density ranging from 0.8 g/cc to 2.0 g.cc.

Clause 5. The golf club head of clause 1, wherein the nanocomposite comprises a mass ranging from 5 to 12 grams.

Clause 6. The golf club head of clause 1, wherein the nanocomposite comprises a hardness of less than or equal to Shore A 50.

Clause 7. The golf club head of clause 1, wherein the polymer is a polyurethane.

Clause 8. The golf club head of clause 1, wherein the nanocomposite is disposed on an interior surface of the club head selected from the group consisting of the strike face, the top rail, the sole, the toe end, the heel end, and the rear;

Clause 9. The golf club head of clause 1, wherein the nanocomposite is disposed on an interior surface of the club head at the strike face, the top rail, and the rear such that a portion of the strike face, the top rail and the rear are coupled together.

Clause 10. A golf club head comprising: a strike face; a top rail; a sole; a toe end; a heel end; and a rear opposite the strike face; wherein the strike face, the top rail, the sole, the toe end, the heel end, and the rear together form a cavity; wherein the cavity is at least partially filled with a nanocomposite; wherein the nanocomposite is disposed on an interior surface of the strike face; wherein the nanocomposite is disposed on a region of the strike face selected from the group consisting of a top region, a bottom region, a heel region, a toe region, and a center region; wherein the nanocomposite comprises a graphene powder and a polymer;

Clause 11. The golf club head of clause 10, wherein the nanocomposite comprises a density ranging from 0.8 g/cc to 2.0 g.cc.

Clause 12. The golf club head of clause 10, wherein the nanocomposite comprises a mass ranging from 5 to 12 grams.

Clause 13. The golf club head of clause 10, wherein the nanocomposite comprises a hardness of less than or equal to Shore A 50.

Clause 14. The golf club head of clause 10, wherein the polymer is a polyurethane.

Clause 15. The golf club head of clause 10, wherein the graphene powder comprises a plurality of flakes; wherein the plurality of flakes comprise an average size of approximately 40 micrometers.

Clause 16. The golf club head of clause 10, wherein the nanocomposite comprises a thickness; wherein the thickness of the nanocomposite is less than 50% of a thickness of the strike face.

Clause 17. A golf club head comprising: a volume greater than 400 cc; a strike face; a crown; a sole; a toe; a heel; and a rear opposite the strike face; wherein the strike face, the crown, the sole, the toe, the heel, and the rear together form a cavity; wherein the cavity is at least partially filled with a nanocomposite; wherein the nanocomposite is disposed on an interior surface of the club head; wherein the nanocomposite is disposed on the interior surface of the club head selected from the group consisting of the strike face, the crown, the sole, the toe, the heel, and the rear; and wherein the nanocomposite comprises a graphene powder and a polymer.

Clause 18. The golf club head of clause 17, wherein the nanocomposite fills less than 50% of a volume of the cavity.

Clause 19. The golf club head of clause 17, wherein the nanocomposite comprises a density ranging from 0.8 g/cc to 2.0 g/cc.

Clause 20. The golf club head of clause 17, wherein the nanocomposite comprises a hardness of less than or equal to Shore A 50.

Clause 21. The golf club head of clause 17, wherein the polymer material is a polyurethane.

Clause 22. The golf club head of clause 17, wherein the graphene powder comprises a plurality of flakes; wherein the plurality of flakes comprise an average size of approximately 40 micrometers.

Various features and advantages of the disclosure are set forth in the following claims.

The invention claimed is:

1. A golf club head comprising:

a strike face, a top rail, a sole, a toe end, a heel end, and a rear opposite the strike face;

a head depth plane extending through a geometric center of the strike face and perpendicular to a loft plane tangent to the strike face;

the strike face, the top rail, the sole, the toe end, the heel end, and the rear together form an interior surface defining a closed cavity having an interior volume; and a nanocomposite partially filling the closed cavity and comprising:

an upper portion, disposed above and spaced from the head depth plane, filling the top rail and spanning across the closed cavity from a back surface of the strike face to the rear, thereby to adhere to a portion of the interior surface associated with a top rail vibration hot spot; and a lower portion extending downward from the upper portion and through the head depth plane towards the sole along only the rear to adhere to a portion of the interior surface associated with a rear vibration hot spot, wherein the lower portion does not contact the back surface of the strike face below the head depth plane;

wherein portions of the closed cavity adjacent the toe end and the heel end are devoid of nanocomposite;

wherein the nanocomposite comprises a graphene powder suspended in a polymer, and wherein the nanocomposite comprises a hardness of less than or equal to Shore A 50.

2. The golf club head of claim 1, wherein the polymer is selected from the group consisting of a polyurethane, polyurethane adhesive, polyurethane elastomer, and a polyurethane based thermoplastic elastomer.

3. The golf club head of claim 1, wherein the nanocomposite fills less than 50% of the interior volume of the closed cavity.

4. The golf club head of claim 1, wherein the nanocomposite fills less than 40% of the interior volume of the closed cavity.

5. The golf club head of claim 1, wherein the nanocomposite comprises a mass ranging from 5 to 12 grams.

6. The golf club head of claim 1, wherein the graphene powder is insoluble.

7. The golf club head of claim 1, wherein the hardness of the nanocomposite is less than Shore A 40.

8. The golf club head of claim 1, wherein the hardness of the nanocomposite ranges between Shore A 15 and Shore A 35.

9. The golf club head of claim 1, wherein the nanocomposite comprises a density ranging from 0.8 g/cc to 2.0 g/cc.

* * * * *